US006656673B2

(12) United States Patent
Matsuda et al.

(10) Patent No.: US 6,656,673 B2
(45) Date of Patent: Dec. 2, 2003

(54) SILVER HALIDE COLOR PHOTOGRAPHIC LIGHT-SENSITIVE MATERIAL AND COLOR IMAGE FORMATION METHOD USING THE SAME

(75) Inventors: Naoto Matsuda, Minami-Ashigara (JP); Hisashi Mikoshiba, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/899,100

(22) Filed: Jul. 6, 2001

(65) Prior Publication Data

US 2002/0025497 A1 Feb. 28, 2002

(30) Foreign Application Priority Data

Jul. 6, 2000 (JP) ..... 2000-205307

(51) Int. Cl.[7] ..... G03C 1/46
(52) U.S. Cl. ..... 430/555; 430/552; 430/558
(58) Field of Search ..... 430/555, 552, 430/558

(56) References Cited

U.S. PATENT DOCUMENTS 5,888,716 A 3/1999 Edwards et al. ..... 430/549
6,162,595 A * 12/2000 Chen ..... 430/504

* cited by examiner

*Primary Examiner*—Hoa Van Le
(74) *Attorney, Agent, or Firm*—Birch, Stewart, Kolasch & Birch, LLP

(57) ABSTRACT

A silver halide color photographic light-sensitive material has a red-, green-, and blue-sensitive emulsion layer in this order from the side closest to a support. The green-sensitive layer contains a coupler represented by formula (MC-I), and the red-sensitive emulsion layer contains a coupler represented by formula (CC-I):

(MC-I)

wherein $R_1$ represents a hydrogen atom or substituent; one of $G_1$ and $G_2$ represents C, the other represents N; and $R_2$ represents a substituent which substitutes one of $G_1$ and $G_2$ which is C; X represents a hydrogen atom or a splitting off group;

(CC-I)

wherein $R_{c1}$ represents a hydrogen atom or alkyl group, $R_{c2}$ represents an alkyl or aryl group, n is 1, 2, or 3, and Y is positioned in the meta and/or para position of the phenyl group with respect to the sulfonyl group, and represents alkyl, alkenyl, alkoxy, aryloxy, acyloxy, acylamino, sulfonyloxy, sulfamoylamino, sulfonamide, ureido, oxycarbonyl, oxycarbonylamino, or carbamoyl group.

19 Claims, No Drawings

SILVER HALIDE COLOR PHOTOGRAPHIC LIGHT-SENSITIVE MATERIAL AND COLOR IMAGE FORMATION METHOD USING THE SAME

CROSS-REFERENCE TO RELATED APPLICATIONS

This application is based upon and claims the benefit of priority from the prior Japanese Patent Application No. 2000-205307, filed Jul. 6, 2000, the entire contents of which are incorporated herein by reference.

BACKGROUND OF THE INVENTION

1. Field of the Invention

The present invention relates to a silver halide color photographic light-sensitive material and a color image formation method using the same.

2. Description of the Related Art

The color reproduction, particularly the saturation of a silver halide color photographic light-sensitive material is an important quality.

In the field of a so-called conventional silver halide color photographic light-sensitive material which uses an aromatic primary amine color developing agent and uses a coupling reaction between the oxidized form of this developing agent and an image forming coupler, various efforts have been made to improve the saturation of obtained images.

One methodology is to improve the spectral absorption characteristics of an image forming dye formed from a coupler.

As a magenta dye forming coupler, a pyrazolotriazole coupler which causes little side absorption and forms a preferred magenta dye is known.

As a cyan dye forming coupler, a phenol coupler as disclosed in, e.g., U.S. Pat. No. 5,686,235 is known as a coupler which causes little side absorption and forms a preferred cyan dye. The fifth position of this phenol coupler is substituted by an acylamino group having a sulfo group, and a dye formed by the coupler associates to produce a preferred hue.

In addition, U.S. Pat. No. 5,888,716 disclosed the combination of this associative phenol cyan coupler and the pyrazolotriazole magenta coupler. In its examples, U.S. Pat. No. 5,888,716 describes applications to silver halide color paper and the degrees of improvements of saturation.

The present inventors made extensive studies on improvements of the saturation of a silver halide color reversal film photographic light-sensitive material, and tested the combination of the cyan coupler and the magenta coupler disclosed in U.S. Pat. No. 5,888,716. Consequently, the graininess was largely worsened by the coupler combination disclosed in U.S. Pat. No. 5,888,716. Usually, the graininess of a silver halide color reversal film, which is formed into a printed document or an original of a print after photographing and development, is an important quality. Therefore, deterioration of the graininess is a crucial problem.

Another problem was that the color forming properties of the cyan coupler and the magenta coupler were unsatisfactory, and the behavior was unbalanced when the pH varied, thereby readily disturbing the color balance. In standard development processes (e.g., the E-6 process and CR56 process) of silver halide color reversal films, the pH of a color developer is set close to 11.9. The color generation behavior of the cyan coupler in this pH range is unknown. Furthermore, the problem that the present inventors encountered, i.e., the easy disturbance of the color balance caused by pH variations is unknown.

Because of the above problems, U.S. Pat. No. 5,888,716 did not disclose a good technique capable of applying the above-mentioned coupler combination to color reversal films. So, further improvements have been demanded.

BRIEF SUMMARY OF THE INVENTION

It is an object of the present invention to provide a silver halide color photographic light-sensitive material superior in color reproduction, graininess, and processing variation resistance, and a color image formation method using the same.

The object of the present invention was achieved by the following arrangements.

(1) A silver halide color photographic light-sensitive material having, on a support, at least one red-sensitive emulsion layer, at least one green-sensitive emulsion layer, and at least one blue-sensitive emulsion layer in this order from the support, wherein the at least one green-sensitive emulsion layer contains a coupler represented by formula (MC-I) below, and the at least one red-sensitive emulsion layer contains a coupler represented by formula (CC-I) below:

(MC-I)

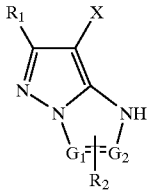

in formula (MC-I), $R_1$ represents a hydrogen atom or substituent; one of $G_1$ and $G_2$ represents a carbon atom, the other represents a nitrogen atom; and $R_2$ represents a substituent which substitutes one of $G_1$ and $G_2$ that is a carbon atom, provide that $R_1$ and $R_2$ can further have a substituent, a polymer having a repeating unit of formula (MC-I) can be formed via $R_1$ and/or $R_2$, and at least one coupler of formula (MC-I) can bond to a polymer chain via $R_1$ or $R_2$; X represents a hydrogen atom or a group which can split off in a coupling reaction with an oxidized formed of an aromatic primary amine color developing agent;

(CC-I)

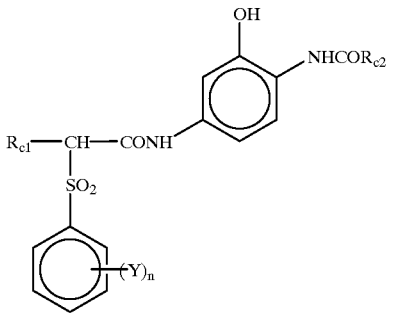

In formula (CC-I), $R_{c1}$ represents a hydrogen atom or alkyl group, $R_{c2}$ represents an alkyl group or aryl group, n is 1, 2, or 3, and each Y is positioned in the meta and/or para position of a phenyl group with respect to the sulfonyl group, and independently represents a group selected from the group consisting of alkyl, alkenyl, alkoxy, aryloxy, acyloxy, acylamino, sulfonyloxy, sulfamoylamino, sulfonamide, ureido, oxycarbonyl, oxycarbonylamino, and carbamoyl groups.

(2) A color image formation method comprising: developing the silver halide color photographic light-sensitive material described in item (1) above with a color developer containing an aromatic primary amine color developing agent and having a pH value of 11.5 or more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The coupler represented by formula (MC-I) will be explained in detail below.

In formula (MC-I), $R_1$ represents a hydrogen atom or substituent, and $R_2$ represents a substituent.

Examples of the substituent represented by $R_1$ and $R_2$ can be, for example, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, alkyl- and arylsulfonylamino groups, a mercapto group, an alkylthio group, an arylthio group, a heterocyclic thio group, a sulfamoyl group, a sulfo group, alkyl- and arylsulfinyl groups, alkyl- and arylsulfonyl groups, an acyl group, an aryloxycarbonyl group, an alkoxycarbonyl group, a carbamoyl group, aryl and heterocyclic azo groups, an imido group, a phosphino group, a phosphinyl group, a phosphinyloxy group, a phosphinylamino group and a silyl group.

More specifically, examples of the substituent represented by $R_1$ and $R_2$ can be a halogen atom (e.g., a chlorine atom, bromine atom, and iodine atom), and an alkyl group [which represents a straight-chain, branched, or cyclic, substituted or unsubstituted alkyl group. Examples are an alkyl group (preferably a substituted or unsubstituted alkyl group having 1 to 30 carbon atoms, e.g., methyl, ethyl, n-propyl, isopropyl, t-butyl, n-octyl, eicosyl, 2-chloroethyl, 2-cyanoethyl, and 2-ethylhexyl), a cycloalkyl group (preferably a, substituted or unsubstituted cycloalkyl group having 3 to 30 carbon atoms, e.g., cyclohexyl, cyclopentyl, and 4-n-dodecylcyclohexyl), a bicycloalkyl group (preferably a substituted or unsubstituted bicycloalkyl group having 5 to 30 carbon atoms, i.e., a monovalent group obtained by removing one hydrogen atom from a bicycloalkane having 5 to 30 carbon atoms. Examples are bicyclo[1,2,2]heptane-2-yl and bicyclo[2,2,2]octane-3-yl).

Examples of the substituent represented by $R_1$ and $R_2$ can also be alkenyl group [which represents a straight-chain, branched, or cyclic, substituted or unsubstituted alkenyl group. Examples are an alkenyl group (preferably a substituted or unsubstituted alkenyl group having 2 to 30 carbon atoms, e.g., vinyl, allyl, prenyl, geranyl, and oleyl), cycloalkenyl group (preferably a substituted or unsubstituted cycloalkenyl group having 3 to 30 carbon atoms, i.e., a monovalent group obtained by removing one hydrogen atom from a cycloalkene having 3 to 30 carbon atoms. Examples are 2-cyclopentene-1-yl and 2-cyclohexene-1-yl), bicycloalkenyl group (a substituted or unsubstituted bicycloalkenyl group, preferably a substituted or unsubstituted bicycloalkenyl group having 5 to 30 carbon atoms, i.e., a monovalent group obtained by removing one hydrogen atom from bicycloalkene having one double bond. Examples are bicyclo[2,2,1)hept-2-ene-1-yl and bicyclo[2,2,2]oct-2-ene-4-yl)].

Examples of the substituent represented by $R_1$ and $R_2$ can also be an alkynyl group (preferably a substituted or unsubstituted alkynyl group having 2 to 30 carbon atoms, e.g., ethynyl, propargyl, and trimethylsilylethynyl), an aryl group (preferably a substituted or unsubstituted aryl group having 6 to 30 carbon atoms, e.g., phenyl, p-tolyl, naphthyl, m-chlorophenyl, and o-hexadecanoylaminophenyl), heterocyclic group (preferably a monovalent group obtained by removing one hydrogen atom from a 5- or 6-membered, substituted or unsubstituted, aromatic or nonaromatic heterocyclic compound, and more preferably, a 5- or 6-membered aromatic heterocyclic group having 3 to 30 carbon atoms. Examples are 2-furyl, 2-thienyl, 2-pyrimidinyl, and 2-benzothiazolyl), cyano group, hydroxyl group, nitro group, carboxyl group, and alkoxy group (preferably a substituted or unsubstituted alkoxy group having 1 to 30 carbon atoms, e.g., methoxy, ethoxy, isopropoxy, t-butoxy, n-octyloxy, and 2-methoxyethoxy).

Examples of the substituent represented by $R_1$ and $R_2$ can also be an aryloxy group (preferably a substituted or unsubstituted aryloxy group having 6 to 30 carbon atoms, e.g., phenoxy, 2-methylphenoxy, 4-t-butylphenoxy, 3-nitrophenoxy, and 2-tetradecanoylaminophenoxy), silyloxy group (preferably a silyloxy group having 3 to 20 carbon atoms, e.g., trimethylsilyloxy and t-butyldimethylsilyloxy), heterocyclic oxy group (preferably a substituted or unsubstituted heterocyclic oxy group having 2 to 30 carbon atoms, e.g., 1-phenyltetrazole-5-oxy and 2-tetrahydropyranyloxy), and acyloxy group (preferably a formyloxy group, a substituted or unsubstituted alkylcarbonyloxy group having 2 to 30 carbon atoms, and a substituted or unsubstituted arylcarbonyloxy group having 7 to 30 carbon atoms, e.g., acetyloxy, pivaloyloxy, stearoyloxy, benzoyloxy, and p-methoxyphenylcarbonyloxy).

Examples of the substituent represented by $R_1$ and $R_2$ can also be a carbamoyloxy group (preferably a substituted or unsubstituted carbamoyloxy group having 1 to 30 carbon atoms, e.g., N,N-dimethylcarbamoyloxy, N,N-diethylcarbamoyloxy, morpholinocarbonyloxy, N,N-di-n-octylaminocarbonyloxy, and N-n-octylcarbamoyloxy), alkoxycarbonyloxy group (preferably a substituted or unsubstituted alkoxycarbonyloxy group having 2 to 30 carbon atoms, e.g., methoxycarbonyloxy, ethoxycarbonyloxy, t-butoxycarbonyloxy, and n-octylcarbonyloxy), and aryloxycarbonyloxy group (preferably a substituted or unsubstituted aryloxycarbonyloxy group having 7 to 30 carbon atoms, e.g., phenoxycarbonyloxy, p-methoxyphenoxycarbonyloxy, and p-(n-hexadecyloxy) phenoxycarbonyloxy).

Examples of the substituent represented by $R_1$ and $R_2$ can also be an amino group (including an anilino group) (preferably an unsubstituted amino group, a substituted or unsubstituted alkylamino group having 1 to 30 carbon atoms, and a substituted or unsubstituted anilino group having 6 to 30 carbon atoms, e.g., methylamino, dimethylamino, anilino, N-methyl-anilino, and diphenylamino), acylamino group (preferably au unsubstituted formylamino group, a substituted or unsubstituted alkylcarbonylamino group having 2 to 30 carbon atoms, and a substituted or unsubstituted arylcarbonylamino group having 7 to 30 carbon atoms, e.g., acetylamino, pivaloylamino, lauroylamino, benzoylamino, and 3,4,5-tri-(n-octyloxy) phenylcarbonylamino), and aminocarbonylamino group (preferably a substituted or unsubstituted aminocarbonylamino having 1 to 30 carbon atoms, e.g., carbamoylamino, N,N-dimethylaminocarbonylamino, N,N-diethylaminocarbonylamino, and morpholinocarbonylamino).

Examples of the substituent represented by $R_1$ and $R_2$ can also be an alkoxycarbonylamino group (preferably a substituted or unsubstituted alkoxycarbonylamino group having 2 to 30 carbon atoms, e.g., methoxycarbonylamino, ethoxycarbonylamino, t-butoxycarbonylamino, n-octadecyloxycarbonylamino, and N-methylmethoxycarbonylamino), aryloxycarbonylamino group (preferably a substituted or unsubstituted aryloxycarbonylamino group having 7 to 30 carbon atoms, e.g., phenoxycarbonylamino, p-chlorophenoxycarbonylamino, and m-(n-octyloxy)phenoxycarbonylamino), sulfamoylamino group (preferably a substituted or unsubstituted sulfamoylamino group having 0 to 30 carbon atoms, e.g., sulfamoylamino, N,N-dimethylaminosulfonylamino, and N-n-(octyl)aminosulfonylamino).

Examples of the substituent represented by $R_1$ and $R_2$ can also be an alkylsulfonylamino and arylsulfonylamino groups (preferably a substituted or unsubstituted alkylsulfonylamino having 1 to 30 carbon atoms, and a substituted or unsubstituted arylsulfonylamino having 6 to 30 carbon atoms, e.g., methylsulfonylamino, butylsulfonylamino, phenylsulfonylamino, 2,3,5-trichlorophenylsulfonylamino, and p-methylphenylsulfonylamino), mercapto group, alkylthio group (preferably a substituted or unsubstituted alkylthio group having 1 to 30 carbon atoms, e.g., methylthio, ethylthio, and n-hexadecylthio), arylthio group (preferably a substituted or unsubstituted arylthio group having 6 to 30 carbon atoms, e.g., phenylthio, p-chlorophenylthio, and m-methoxyphenylthio), and heterocyclic thio group (preferably a substituted or unsubstituted heterocyclic thio group having 3 to 30 carbon atoms, to which an aromatic ring such as a benzene ring may be condenced, e.g., 2-benzothiazolylthio and 1-phenyl-tetrazole-5-ylthio).

Examples of the substituent represented by $R_1$ and $R_2$ can also be a sulfamoyl group (preferably a substituted or unsubstituted sulfamoyl group having 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), sulfo group, alkylsulfinyl and arylsulfinyl groups (preferably a substituted or unsubstituted alkylsulfinyl group having 1 to 30 carbon atoms, and a substituted or unsubstituted arylsulfinyl group having 6 to 30 carbon atoms, e.g., methylsulfinyl, ethylsulfinyl, phenylsulfinyl, and p-methylphenylsulfinyl).

Examples of the substituent represented by $R_1$ and $R_2$ can also be an alkylsulfonyl and arylsulfonyl groups (preferably a substituted or unsubstituted alkylsulfonyl group having 1 to 30 carbon atoms, and a substituted or unsubstituted arylsulfonyl group having 6 to 30 carbon atoms, e.g., methylsulfonyl, ethylsulfonyl, phenylsulfonyl, and p-methylphenylsulfonyl), acyl group (preferably a formyl group substituted or unsubstituted alkylcarbonyl group having 2 to 30 carbon atoms, and a substituted or unsubstituted arylcarbonyl group having 7 to 30 carbon atoms, e.g., acetyl, pivaloyl, 2-chloroacetyl, stearoyl, benzoyl, p-(n-octyloxy) phenylcarbonyl, aryloxycarbonyl group (preferably a substituted or unsubstituted aryloxycarbonyl group having 7 to 30 carbon atoms, e.g., phenoxycarbonyl, o-chlorophenoxycarbonyl, m-nitrophenoxycarbonyl, and p-(t-butyl)phenoxycarbonyl), and an alkoxycarbonyl group (e.g., a substituted or unsubstituted alkoxycarbonyl group having 2 to 30 carbon atoms, e.g., methoxycarbonyl, ethoxycarbonyl, t-butoxycarbonyl, and n-octadecyloxycarbonyl).

Examples of the substituent represented by $R_1$ and $R_2$ can also be a carbamoyl group (preferably a substituted or unsubstituted carbamoyl having 1 to 30 carbon atoms, e.g., carbamoyl, N-methylcarbamoyl, N,N-dimethylcarbamoyl, N,N-di-(n-octyl)carbamoyl, and N-(methylsulfonyl) carbamoyl), arylazo and heterocyclic azo groups (preferably a substituted or unsubstituted arylazo group having 6 to 30 carbon atoms, and a substituted or unsubstituted heterocyclic azo group having 3 to 30 carbon atoms, e.g., phenylazo, p-chlorophenylazo, and 5-ethylthio-1,3,4-thiadiazole-2-ylazo), imide group (preferably N-succinimide and N-phthalimide), phosphino group (preferably a substituted or unsubstituted phosphino group having 2 to 30 carbon atoms, e.g., dimethylphosphino, diphenylphosphino, and methylphenoxyphosphino), and phosphinyl group (preferably a substituted or unsubstituted phosphinyl group having 2 to 30 carbon atoms, e.g., phosphinyl, dioctyloxyphosphinyl, and diethoxyphosphinyl).

Examples of the substituent represented by $R_1$ and $R_2$ can also be a phosphinyloxy group (preferably a substituted or unsubstituted phosphinyloxy group having 2 to 30 carbon atoms, e.g., diphenoxyphosphinyloxy and dioctyloxyphosphinyloxy), phosphinylamino group (preferably a substituted or unsubstituted phosphinylamino group having 2 to 30 carbon atoms, e.g., dimethoxyphosphinylamino and dimethylaminophosphinylamino), and silyl group (preferably a substituted or unsubstituted silyl group having 3 to 30 carbon atoms, e.g., trimethylsilyl, t-butyldimethylsilyl, and phenyldimethylsilyl).

Of the above substituents, those having a hydrogen atom may be further substituted by the above groups by removing the hydrogen atom. Examples of such substituents are an alkylcarbonylaminosulfonyl group, arylcarbonylaminosulfonyl group, alkylsulfonylaminocarbonyl group, and arylsulfonylaminocarbonyl group. Examples of these groups are methylsulfonylaminocarbonyl, p-methylphenylsulfonylaminocarbonyl, acetylaminosulfonyl, and a benzoylaminosulfonyl group.

Preferred examples of $R_1$ are a hydrogen atom, alkyl group, aryl group, alkoxy group, aryloxy group, amino group, acylamino group, arylthio group, alkylthio group, aminocarbonylamino group, alkoxycarbonylamino group, carbamoyloxy group, and heterocyclic thio group. These groups can have substituents.

$R_1$ is more preferably an alkyl group, aryl group, alkoxy group, aryloxy group, or amino group (including an anilino group), further preferably a secondary or tertiary alkyl group having a total of 3 to 15 carbon atoms, and most preferably a tertiary alkyl group having 4 to 10 carbon atoms.

One of $G_1$ and $G_2$ is a nitrogen atom, and the other is a carbon atom. $R_2$ shown in formula (MC-I) substitutes one of $G_1$ and $G_2$ which is a carbon atom. In the present invention, it is preferable that $G_1$ be a carbon atom, $G_2$ be a nitrogen atom, and $R_2$ substitute $G_1$.

A dimer having a repeating unit represented by formula (MC-I) may be formed via $R_1$ and/or $R_2$, from which a hydrogen atom is removed. A trimer or a higher polymer may be formed via $R_1$ and $R_2$, from each of which a hydrogen atom is removed.

The coupler represented by formula (MC-I) may bond to a polymer chain via $R_1$ or $R_2$, from which a hydrogen atom is removed. The number of the coupler that bonds to the polymer chain is not particularly limied.

If a coupler represented by formula (MC-1) forms a polymer, this polymer is preferably a dimer, trimer, or tetramer and most preferably a dimer. Also, if this coupler bonds to a polymer chain, the total molecular weight is preferably 8,000 to 100,000, and the molecular weight per coupler nucleus is preferably 500 to 1,000.

Preferred examples of $R_2$ are an alkyl group, aryl group, alkoxy group, aryloxy group, alkylthio group, aminocarbonylamino group, alkoxycarbonylamino group, and acylamino group. $R_2$ is more preferably a group having a total of 6 to 70 carbon atoms, which contains a $C_6$ to $C_{30}$ alkyl group or aryl group as a partial structure. This group preferably gives immobility to a coupler represented by formula (MC-I).

It also preferable that $R_2$ is a divalent group obtained by removing a hydrogen atom from an alkyl group, aryl group, alkoxy group, aryloxy group, alkylthio group, aminocarbonylamino group, alkoxycarbonylamino group, or acylamino group, or a combined divalent group formed by two or more these divalent groups. Such a divalent group bonds to a polymer chain thereby gives immobility to a coupler represented by formula (MC-I).

In this specification, $C_n$ means that a number of carbon atoms of a group is n. For example, a $C_6$ to $C_{30}$ alkyl group means an alkyl group having 6 to 30 carbon atoms.

In this specification, "a group (or substituent) containing an aryl group as a partial structure" includes a case in which this group is substituted by an aryl group, and a case in which the group itself is an aryl group. This holds for a case in which a group (e.g., an alkyl group) other than an aryl group is contained as a partial structure. That is, "a group (or substituent) containing an alkyl group as a partial structure" includes a case in which this group is substituted by an alkyl group, and a case in which the group itself is an alkyl group.

X represents a hydrogen atom or a group which can split off by a coupling reaction with an oxidized form of an aromatic primary amine color developing agent. Examples of the split-off group other than a hydrogen atom are a halogen atom, alkoxy group, aryloxy group, acyloxy group, alkylsulfonyloxy or arylsulfonyloxy group, acylamino group, alkylsulfonamide or arylsulfonamide group, alkoxycarbonyloxy group, aryloxycarbonyloxy group, alkylthio, arylthio, or heterocyclic thio group, carbamoylamino group, carbamoyloxy group, 5- or 6-membered, nitrogen-containing heterocyclic group, imide group, and arylazo group. These groups can be further substituted by groups enumerated as substituents of $R_2$.

More specifically, examples of X are a halogen atom (e.g., a fluorine atom, chlorine atom, and bromine atom), alkoxy group (e.g., ethoxy, dodecyloxy, methoxyethylcarbamoylmethoxy, carboxypropyloxy, methylsulfonylethoxy, and ethoxycarbonylmethoxy), aryloxy group (e.g., 4-methylphenoxy, 4-chlorophenoxy, 4-methoxyphenoxy, 4-carboxyphenoxy, 4-methoxycarboxyphenoxy, 4-carbamoylphenoxy, 3-ethoxycarboxyphenoxy, 3-acetylaminophenoxy, and 2-carboxyphenoxy), acyloxy group (e.g., acetoxy, tetradecanoyloxy, and benzoyloxy), alkylsulfonyloxy or arylsulfonyloxy group (e.g., methanesulfonyloxy and toluenesulfonyloxy), acylamino group (e.g., dichloroacetylamino and heptafluorobutyloylamino), alkylsulfonamide or arylsulfonamide group (e.g., methanesulfonamino, trifluoromethanesulfonamino, and p-toluenesulfonylamino), alkoxycarbonyloxy group (e.g., ethoxycarbonyloxy and benzyloxycarbonyloxy), aryloxycarbonyloxy group (e.g., phenoxycarbonyloxy), alkylthio, arylthio, or heterocyclic thio group (e.g., dodecylthio, 1-carboxydodecylthio, phenylthio, 2-butoxy-5-t-octylphenylthio, and tetrazolylthio), carbamoylamino group (e.g., N-methylcarbamoylamino and N-phenylcarbamoylamino), carbamoyloxy group (e.g., N,N-dimethylcarbamoyloxy, N-phenylcarbamoyloxy, morpholinylcarbonyloxy, and pyrrolidinylcarbonyloxy), 5- or 6-membered, nitrogen-containing heterocyclic group (e.g., imidazolyl, pyrazolyl, triazolyl, tetrazolyl, and 1,2-dihydro-2-oxo-1-pyridyl), imide group (e.g., succinimidyl and hydantoinyl), and arylazo group (e.g., phenylazo and 4-methoxyphenylazo). X can also take the form of a bis coupler obtained by condensing a 4-equivalent coupler by aldehydes or ketones, as a split-off group bonded via a carbon atom.

X is preferably a hydrogen atom, a halogen atom, an aryloxy group, an alkylthio or arylthio group, or a 5- or 6-membered, nitrogen-containing heterocyclic group which bonds to the coupling active position by a nitrogen atom, and particularly preferably a hydrogen atom, a chlorine atom, or a phenoxy group which can be substituted. In the present invention, a hydrogen atom is most preferred in respect of a change of color balance between cyan dye and magenta dye caused by changes in processing condition, especially pH of the color developer used.

In a preferred coupler represented by formula (MC-I), $R_1$ is a secondary or tertiary alkyl group or an aryl group, $G_1$ is a carbon atom, $G_2$ is a nitrogen atom, $R_2$ is a substituted alkyl group or a substituted aryl group. The substituent of the substituted alkyl group and the substituted aryl group represented by $R_2$ is selected from an alkoxy group, aryloxy group, acylamino group, aminocarbonylamino group, alkylthio group, arylthio group, alkoxycarbonylamino group, aryloxycarbonylamino group, alkylsulfonylamino and arylsulfonylamino groups, carbamoyl group, sulfamoyl group, sulfonyl group, alkoxycarbonyl group, acyloxy group, carbamoyloxy group, sulf inyl group, phosphonyl group, acyl group, and halogen atom, and X is a hydrogen atom, a chlorine atom, or a phenoxy group which can be substituted. X is more preferably a hydrogen atom.

Formula (MC-1) is more preferably a compound in which $R_2$ is a substituent represented by formula (BL-1) or (BL-2) below:

(BL-1)

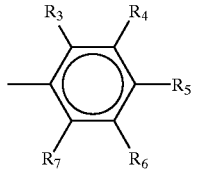

(BL-2)

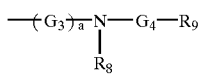

In formula (BL-1), each of $R_3$, $R_4$, $R_5$, $R_6$, and $R_7$ independently represents a hydrogen atom or a substituent, and at least one of them represents a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure.

A group represented by formula (BL-1) will be described below. Each of $R_3$, $R_4$, $R_5$, $R_6$, and $R_7$ independently represents a hydrogen atom or a substituent. Examples of this substituent are those enumerated above for $R_2$. At least one of $R_3$, $R_4$, $R_5$, $R_6$, and $R_7$ is a substituent having a total of 4 to 70 carbon atoms and containing a substituted or unsubstituted alkyl group as a partial structure, or a substituent having a total number of 6 to 70 carbon atoms and containing a substituted or unsubstituted aryl group as a partial structure. Preferred examples are an alkoxy group, an aryloxy group, an acylamino group, an aminocarbonylamino group, a carbamoyl group, an alkoxycarbonylamino group, a sulfonyl group, an alkylsulfonylamino group, an arylsulfonylamino group, a sulfamoyl group, a sulfamoylamino group, an alkoxycarbonyl group, an alkyl group, and an aryl group, each having a total of 4 (6 if an aryl group is contained) to 70 carbon atoms, and each containing a substituted or unsubstituted alkyl or a substituted or non substituted aryl group as a partial structure.

Of these substituents, a $C_4$ to $C_{70}$ alkyl group, and an alkoxy group, aryloxy group, acylamino group (alkylcarbonylamino group or arylcarbonylamino group), alkylsulfonylamino group, and arylsulfonylamino group, each containing a $C_4$ ($C_6$ if an aryl group is contained) to $C_{70}$ alkyl group as a partial structure are preferred. The term "containing as a partial structure", for example, an arylsulfonylamino group containing a $C_4$ to $C_{70}$ alkyl group as a partial structure means that a $C_4$ to $C_{70}$ alkyl group is substituted to the aryl group of the arylsulfonylamino group directly or via a divalent group.

In particular, $R_3$ or both of $R_4$ and $R_6$ are preferably the above mentioned substituents having a total of 4 (6 if an aryl group is contained) to 70 carbon atoms, and containing a substituted or unsubstituted alkyl or aryl group as a partial structure.

In formula (BL-2), $G_3$ represents a substituted or unsubstituted methylene group, a represents an integer from 1 to 3, $G_4$ represents —O—, —$SO_2$—, —$NR_8CO$—, or —$NR_8SO_2$—, $R_8$ represents a hydrogen atom, alkyl group, or aryl group, $R_9$ represents a substituent having a total of 6 to 70 carbon atoms and containing a substituted or unsubstituted alkyl or aryl group as a partial structure.

If $R_9$ has a substituent, examples of this substituent are those enumerated above for $R_2$.

If a is 2 or more, a plurality of $G_3$'s can be the same or different.

A substituted or unsubstituted methylene group represented by $G_3$ is preferably simple methylene or a methylene group substituted by a 1- to 20-carbon alkyl group or a substituted or unsubstituted phenyl group. a represents a natural number from 1 to 3, preferably 1 or 2.

More preferably, a group represented by $(G_3)_a$ is —$CH_2$—, $C(CH_3)H$—, —$C(CH_3)_2$—, —$C_2H_4$—, —$C(CH_3)H$—$CH_2$—, —$C(CH_3)_2$—$CH_2$—, —$C(CH_3)_2$—$C(CH_3)H$—, —$C(CH_3)H$—$C(CH_3)H$—, —$C(CH_3)_2$—$C(CH_3)_2$—, —$C(i$—$C_3H_7)H$—, or —$C(i$—$C_3H_7)H$—$CH_2$—.

$G_4$ is preferably —$NR_8CO$— or —$NR_8SO_2$—, and $R_8$ is preferably a hydrogen atom.

$R_9$ is preferably a substituted or unsubstituted alkyl or aryl group having a total of 10 to 70 carbon atoms, and the aryl group is preferably a phenyl group.

In a compound represented by formula (MC-1), if $G_1$ is a nitrogen atom and $G_2$ is a carbon atom, it is preferable that $R_1$ be a tertiary alkyl group, $R_2$ be a group represented by formula (BL-1), each of $R_4$ and $R_6$ be a group selected from the group consisting of an acylamino group, sulfonamide group, ureido group, alkoxycarbonylamino group, sulfonyl group, carbamoyl group, sulfamoyl group, sulfamoylamino group, and alkoxycarbonyl group, each of which are substituted by a substituted or unsubstituted alkyl group having a total of 4 or more carbon atoms or by a substituted or unsubstituted aryl group having 6 or more carbon atoms, and X be a hydrogen atom.

In a compound represented by formula (MC-1), if $G_1$ is a carbon atom and $G_2$ is a nitrogen atom, it is preferable that $R_1$ be a tertiary alkyl group and $R_2$ be a group represented by formula (BL-1) or (BL-2). Most preferably, $R_2$ is a group represented by formula (BL-2) or a group represented by formula (BL-1) in which each of $R_3$ and $R_7$ is a $C_1$ to $C_6$ alkyl group and at least one of $R_4$, $R_5$, and $R_6$ is a group having a total of 6 to 70 carbon atoms and containing a substituted or unsubstituted alkyl or aryl group as a partial structure, and X is a hydrogen atom.

In the present invention, it is preferable that $G_1$ be a carbon atom, $G_2$ be a nitrogen atom, $R_1$ be a tertiary alkyl group, and $R_2$ be represented by formula (BL-2) in which Rg is a phenyl group having at least one substituent, wherein the substituent contains a $C_6$ to $C_{70}$ alkyl group as a partial structure, and a is 1 or 2. Most preferably, $R_9$ is a group having a group selected from —OH, —$SO_2NH_2$, —$SO_2NHR_{10}$, —$NHSO_2R_{10}$, —$SO_2NHCOR_{10}$, —$CONHSO_2R_{10}$, —COOH, and —$CONH_2$ as a partial structure.

$R_{10}$ represents a substituted or unsubstituted alkyl group or aryl group. If $R_{10}$ is an aryl group, this aryl group is preferably a phenyl group, and this phenyl group is preferably substituted by at least one electron attracting group. Preferred examples of this electron attracting group are a halogen atom, a cyano group, an alkyl group substituted by at least one halogen atom, an aryl group substituted by at least one halogen atom, an acyl group, a carbamoyl group, an alkyloxycarbonyl or aryloxycarbonyl group, a sulfonyl group, and an alkylaminosulfonyl or arylaminosulfonyl group.

If $R_{10}$ is an alkyl group, this alkyl group is preferably a $C_1$ to $C_{50}$ (more preferably $C_1$ to $C_{30}$), substituted or unsubstituted, straight-chain or branched alkyl group.

Practical compound examples of formula (MC-1) will be presented below, but the present invention is not limited to these practical examples.

MC-1

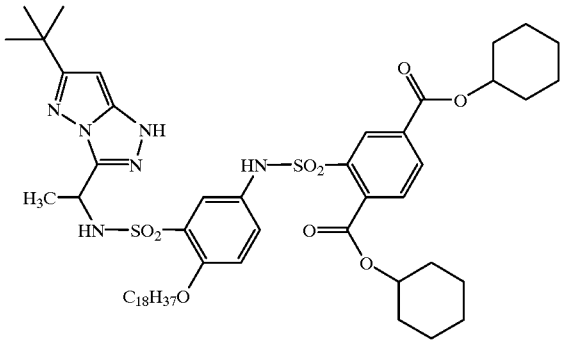

MC-2

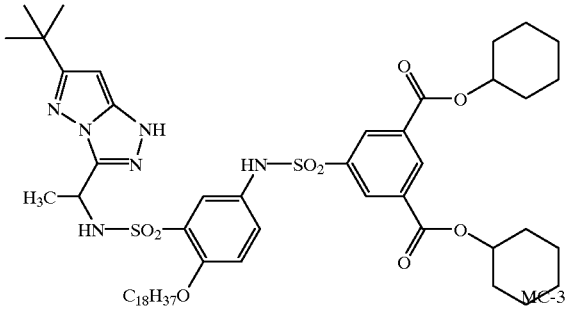

MC-3

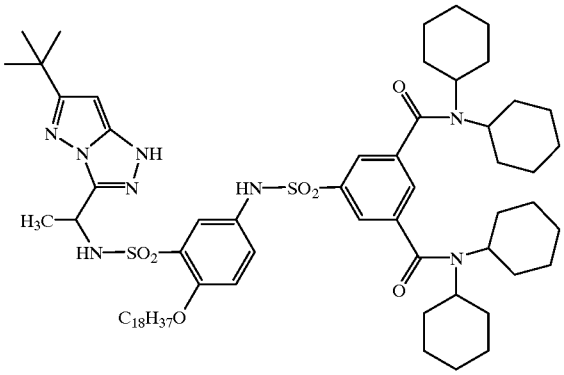

MC-4

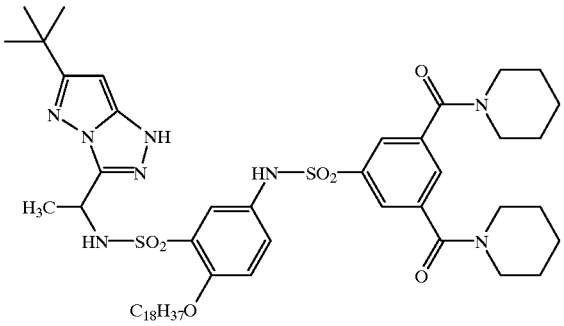

MC-5

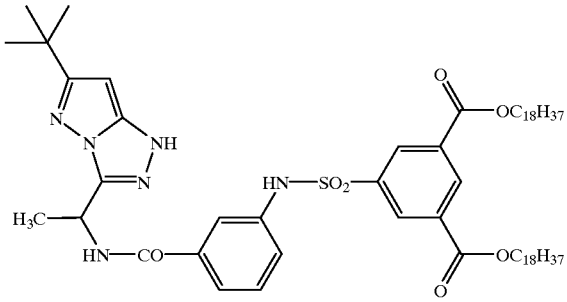

MC-6

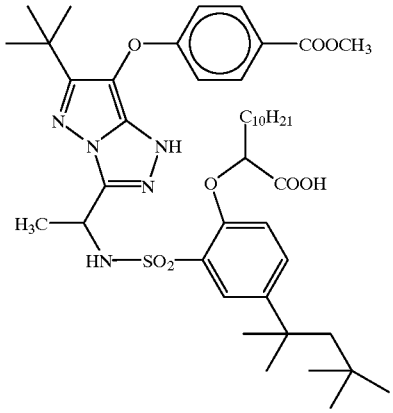

MC-7

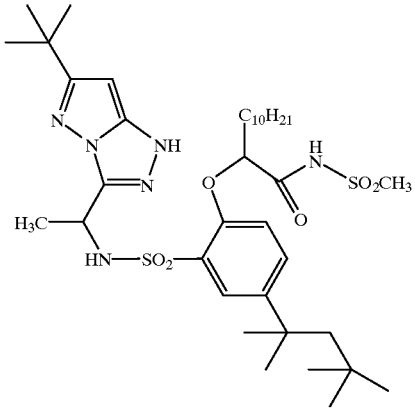

MC-8

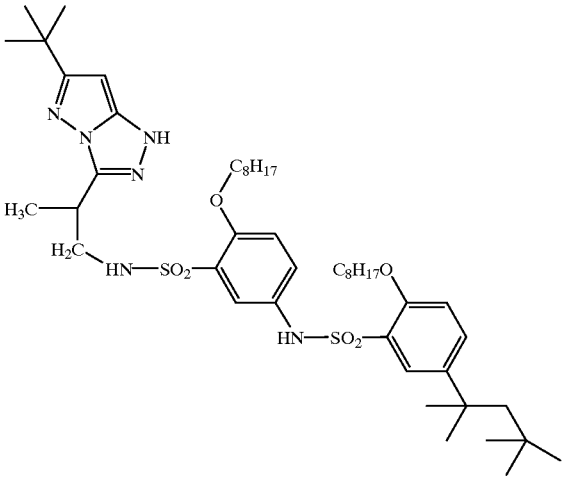

* Alkyl groups are normal-alkyl groups, except otherwise indicated.

-continued
MC-9
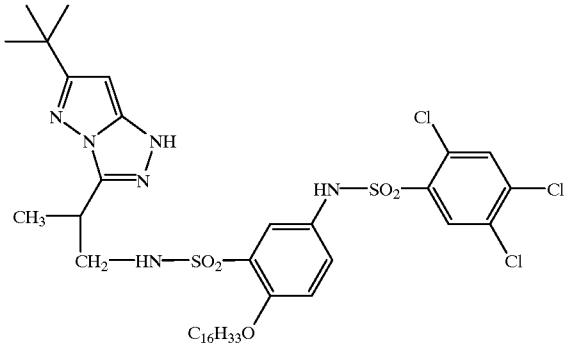
MC-10
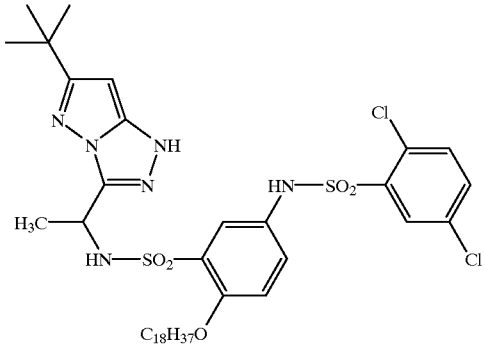
MC-11
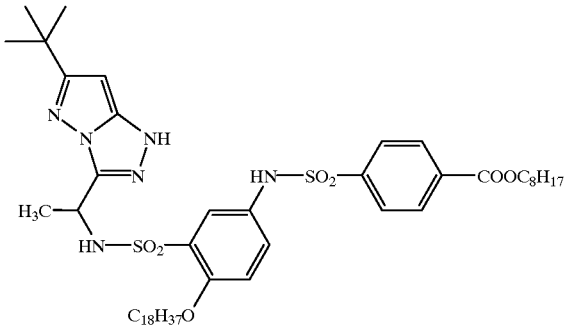
MC-12
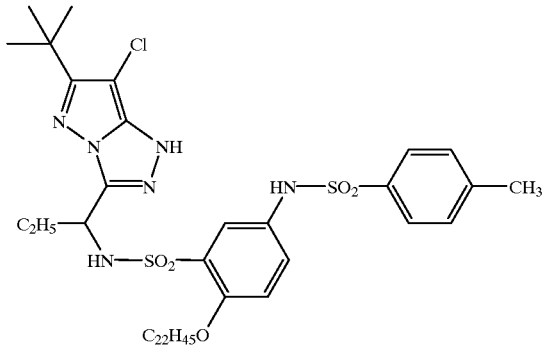
-continued
MC-13
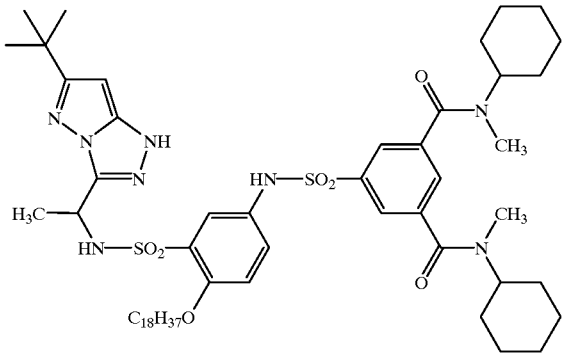
MC-14
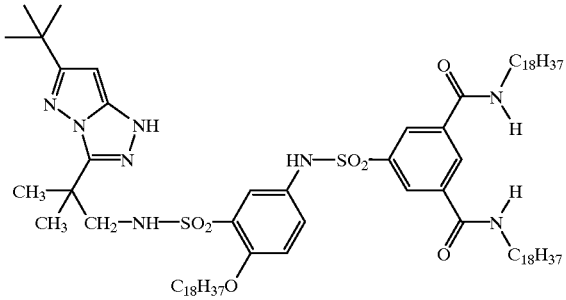
MC-15
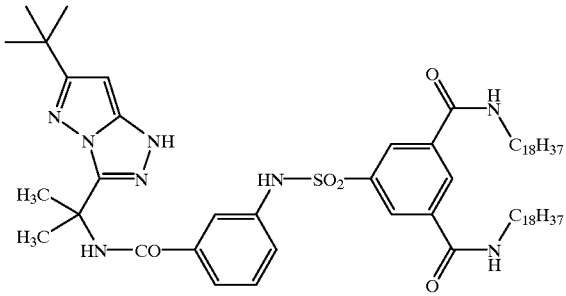
MC-16
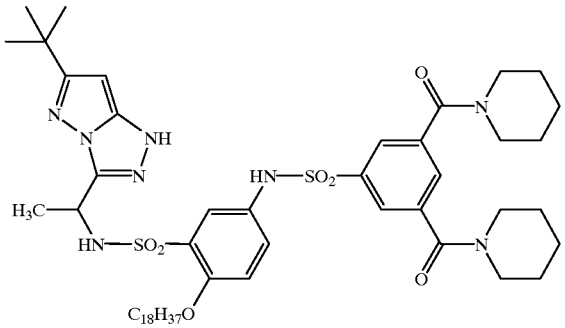

-continued
MC-17
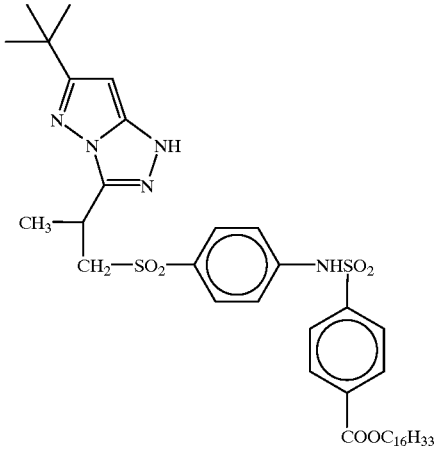
MC-18
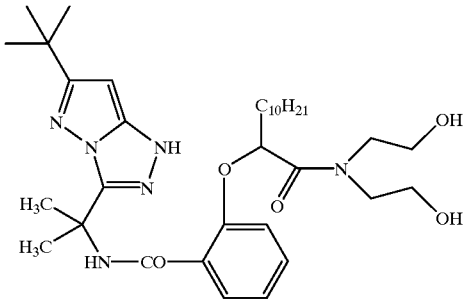
MC-19
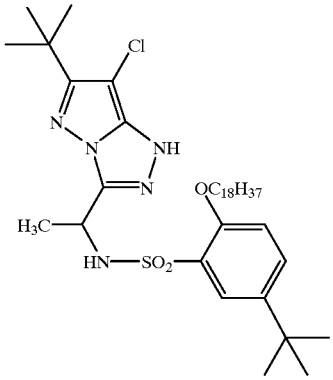
MC-20
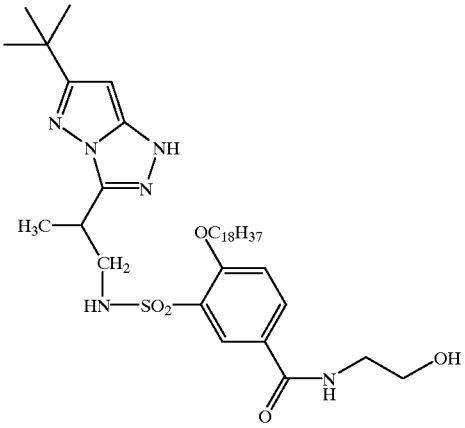
-continued
MC-21
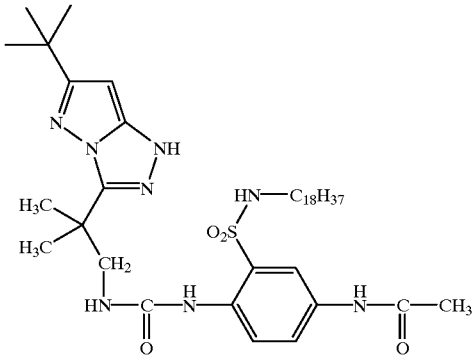
MC-22
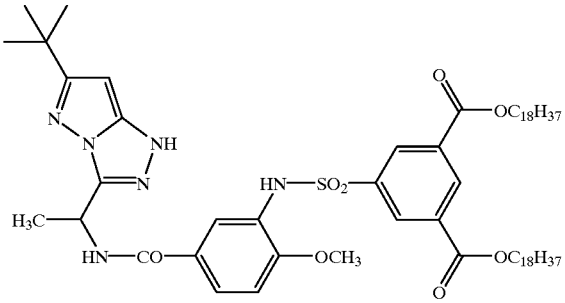
MC-23
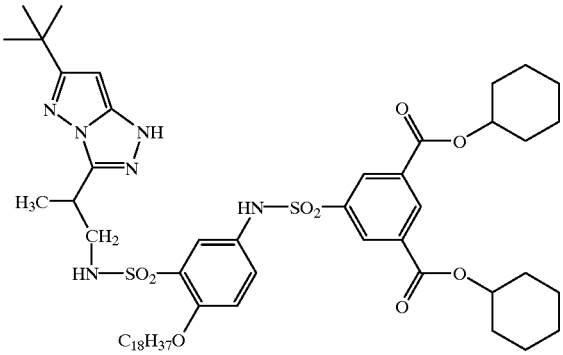
MC-24
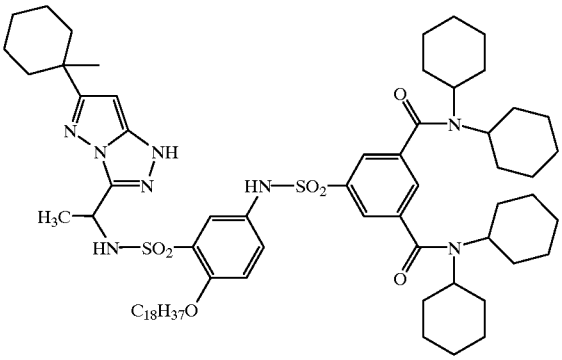

-continued
MC-25
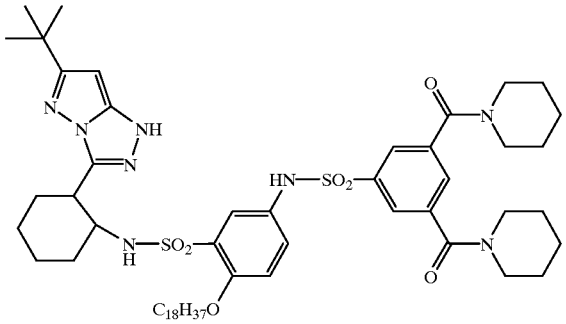
MC-26
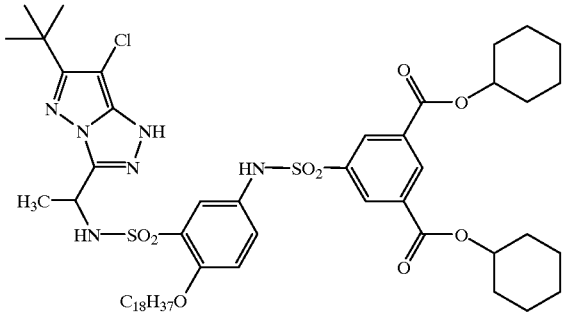
MC-27
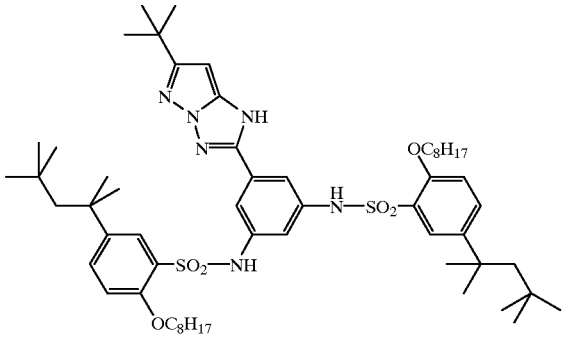
MC-28
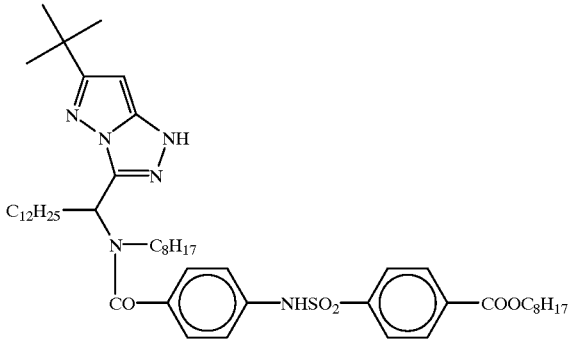
-continued
MC-29
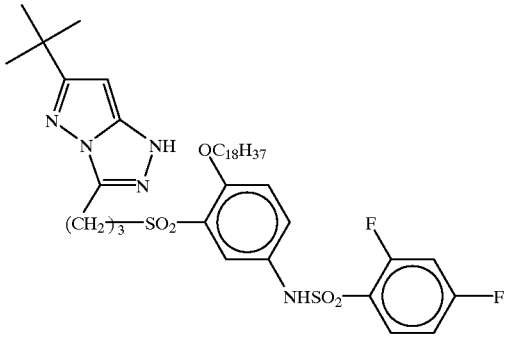
MC-30
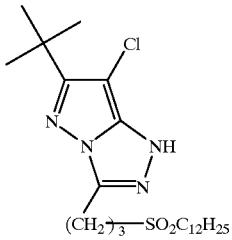
MC-31
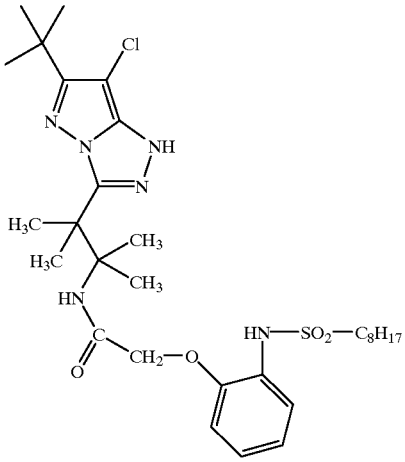
MC-32
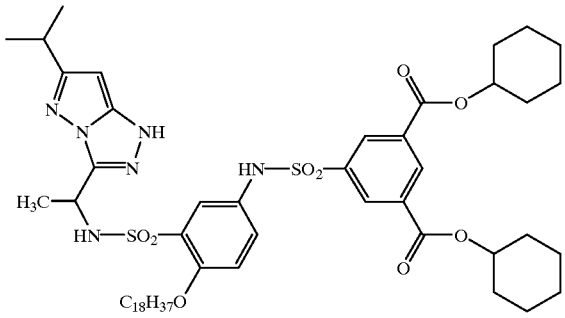

-continued

MC-33

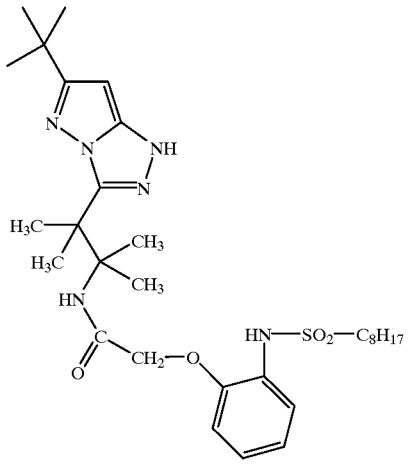

MC-34

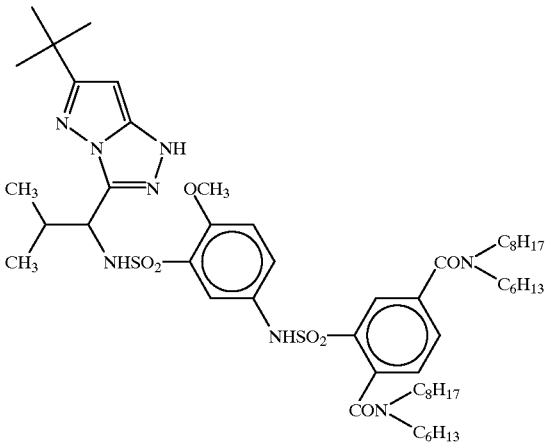

A coupler represented by formula (MC-1) of the present invention can be synthesized by known methods. Examples are described in U.S. Pat. Nos. 4,540,654, 4,705,863, and 5,451,501, Jpn. Pat. Appln. KOKAI Publication Nos. (hereinafter referred to as JP-A's)-61-65245, 62-209457, 62-249155, and 63-41851, Jpn. Pat. Appln. KOKOKU Publication Nos. (hereinafter referred to as JP-B's)-7-122744, 5-105682, 7-13309, and 7-82252, U.S. Pat. Nos. 3,725,067 and 4,777,121, and JP-A's-2-201442, 2-101077, 3-125143, and 4-242249.

Formula (CC-I) of the present invention will be described below.

In formula (CC-I), $R_{c1}$ represents hydrogen or an alkyl group; $R_{c2}$ represents an alkyl group or aryl group; n is 1, 2, or 3; and each Y is positioned in the meta and/or para position of a phenyl group with respect to a sulfonyl group, and independently represents a group selected from the group consisting of alkyl, alkenyl, alkoxy, aryloxy, acyloxy, acylamino, sulfonyloxy, sulfamoylamino, sulfonamide, ureido, oxycarbonyl, oxycarbonylamino, and carbamoyl groups.

In formula (CC-I), $R_{c1}$ represents hydrogen or an alkyl group, e.g., a $C_1$ to $C_{10}$ straight-chain, branched, or cyclic, substituted or unsubstituted (preferably unsubstituted) alkyl group. $R_{c1}$ is preferably a methyl, ethyl, n-propyl, isopropyl, or butyl group and most preferably an ethyl group.

$R_{c2}$ represents a substituted or unsubstituted alkyl group or a substituted or unsubstituted aryl group.

$R_{c2}$ is preferably a $C_1$ to $C_{20}$ substituted or unsubstituted alkyl group or a 6- to 20-carbon, substituted or unsubstituted aryl group, and more preferably a $C_1$ to $C_4$ substituted or unsubstituted alkyl group (e.g., methyl, propyl, trifluoromethyl, or heptafluoropropyl) or a $C_6$ to $C_{30}$ substituted or unsubstituted aryl group. When the alkyl and aryl groups are substituted ones, examples of the substituent are a halogen atom, cyano group, carbonyl group, carbonamide group, sulfonamide group, carboxy group, sulfo group, alkyl group, aryl group, alkoxy group, aryloxy group, alkylthio group, arylthio group, alkylsulfonyl group, and arylsulfonyl group.

$R_{c2}$ is most preferably a heptafluoropropyl group, 4-chlorophenyl group, 3,4-dichlorophenyl group, 4-cyanophenyl group, 3-chloro-4-cyanophenyl group, pentafluorophenyl group, 4-carbonamidophenyl group, 4-sulfonamidophenyl group, or alkylsulfonylphenyl group.

In formula (CC-I), Y's are positioned in the meta and/or para position of the phenyl ring, and each independently represent a straight-chain or branched alkyl or alkenyl group (e.g., methyl, t-butyl, dodecyl, pentadecyl, octadecyl, or allyl), alkoxy group (e.g., methoxy, t-butoxy, or tetradecyloxy), aryloxy group (e.g., phenoxy, 4-t-butylphenoxy, or 4-dodecylphenoxy), alkylcarbonyloxy or arylcarbonyloxy group (e.g., acetoxy, dodecanoyloxy, benzolyoxy, or p-octyloxybenzoyloxy), alkylacylamino or arylacylamino group (e.g., acetamide, benzamide, or hexadecaneamide), alkylsulfonyloxy or arylsulfonyloxy group (e.g., methylsulfonyloxy, dodecylsulfonyloxy, or 4-methylphenylsulfonyloxy), alkylsulfamoylamino or arylsulfamoylamino group (e.g., N-butylsulfamoylamino or N-4-butylphenylsulfamoylamino), alkylsulfonamide or arylsulfonamide group (e.g., methanesulfonamide, 4-chlorophenylsulfonamide, or hexadecanesulfonamide), aminocarbonylamino group (e.g., methylaminocarbonylamino or anilinocarbonylamino), alkoxycarbonylamino or aryloxycarbonylamino group (e.g., methoxycarbonylamino or phenoxycarbonylamino), or carbamoyl group (e.g., N-butylcarbamoyl or N-methyl-N-dodecylcarbamoyl).

Each Y represents any of the above groups which is a straight-chain group having preferably 1 to 30 and more preferably 8 to 20 carbon atoms. Y is most preferably a $C_{12}$ to $C_{18}$ straight-chain alkyl group. Examples are n-dodecyl, n-pentadecyl, and n-octadecyl.

n represents 1, 2, or 3. If n is 2 or 3, Y's can be the same or different.

Practical compound examples of formula (CC-I) of the present invention will be presented below, but the present invention is not restricted to these practical examples.

CC-1

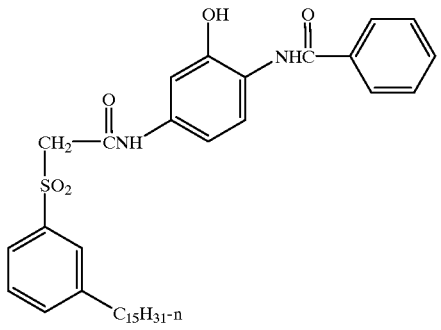

-continued
CC-2
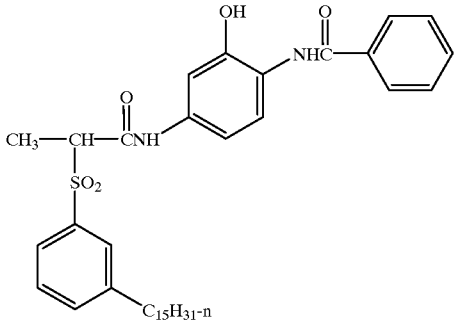
CC-3
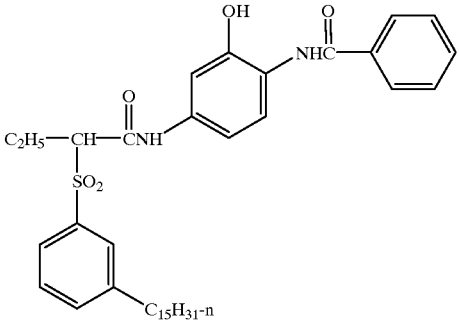
CC-4
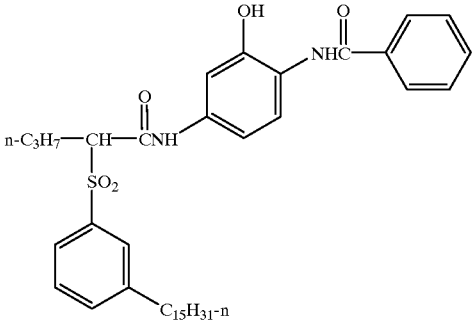
CC-5
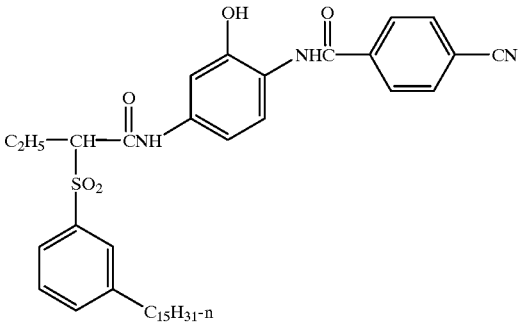
-continued
CC-6
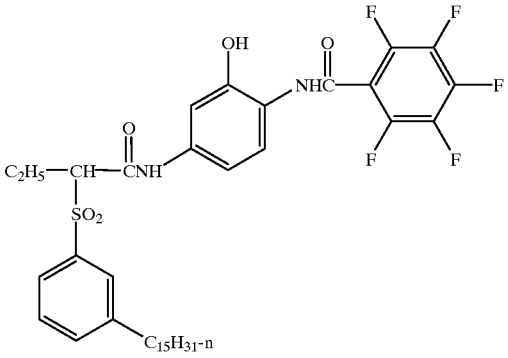
CC-7
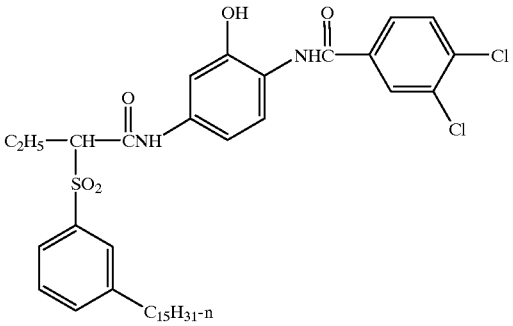
CC-8
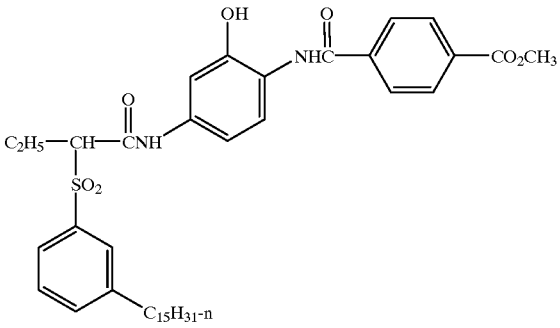
CC-9
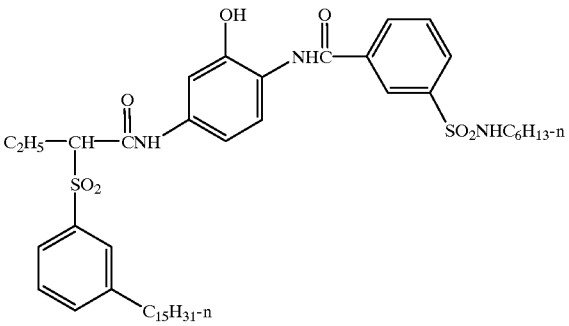

-continued
CC-10
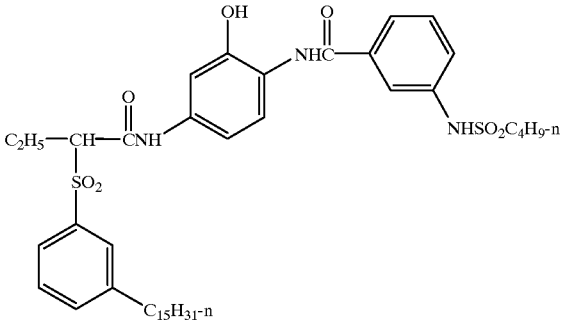
CC-11
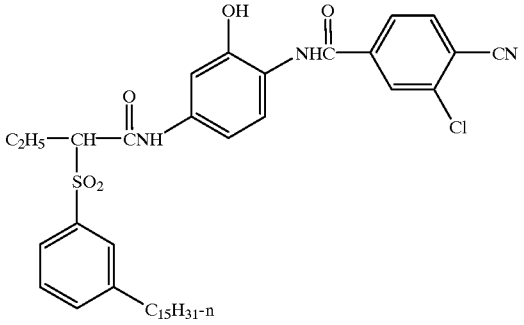
CC-12
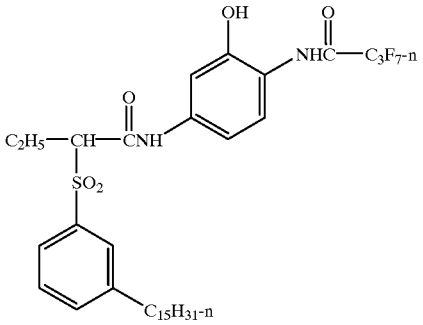
CC-13
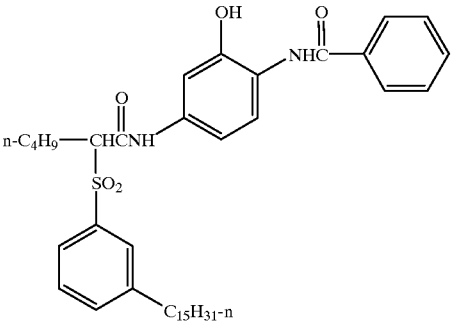
-continued
CC-14
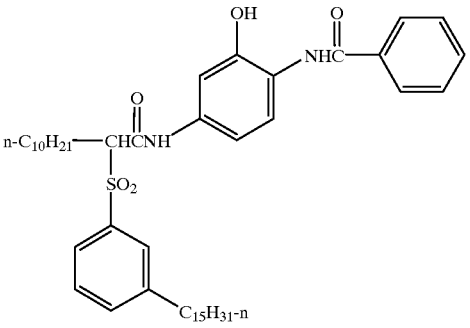
CC-15
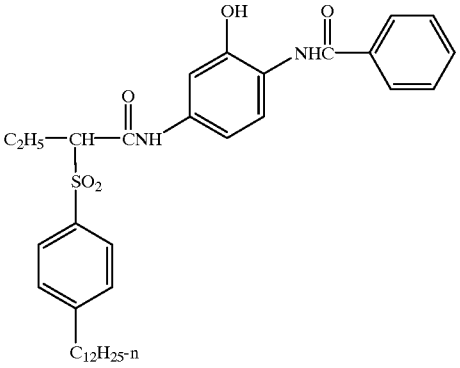
CC-16
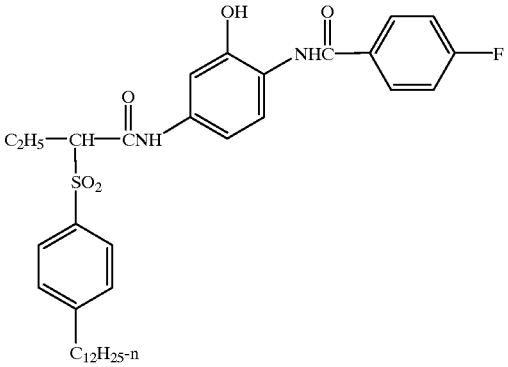
CC-17
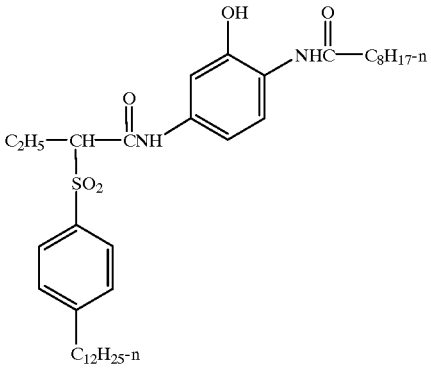

-continued
CC-18
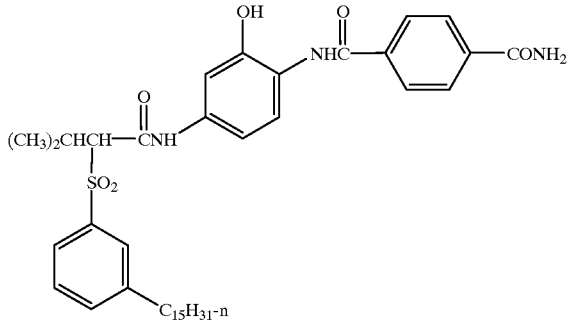
CC-19
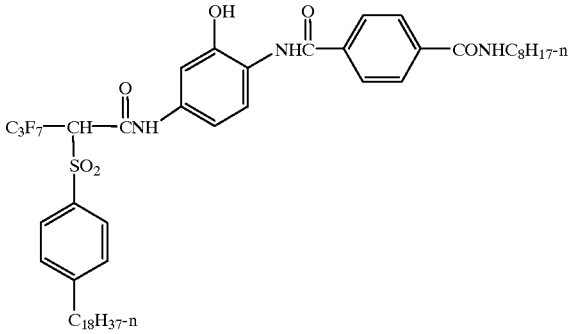
CC-20
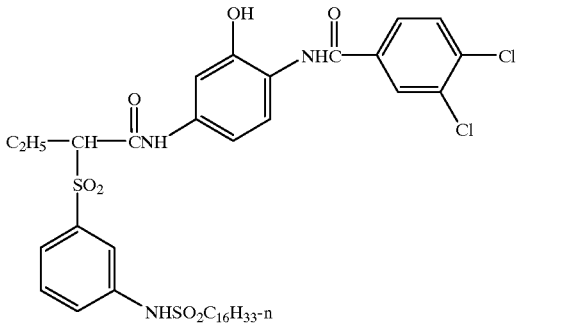
CC-21
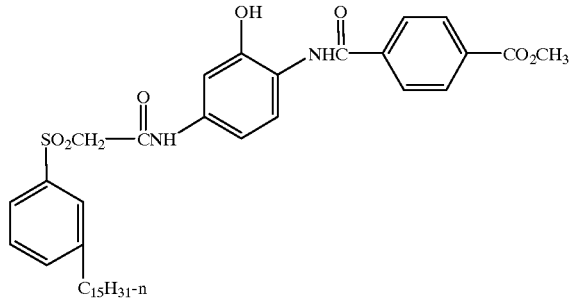
-continued
CC-22
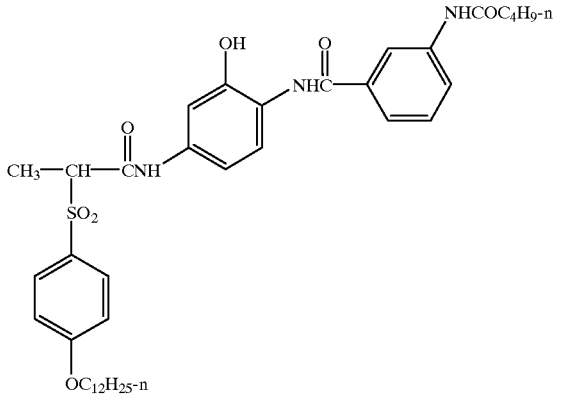
CC-23
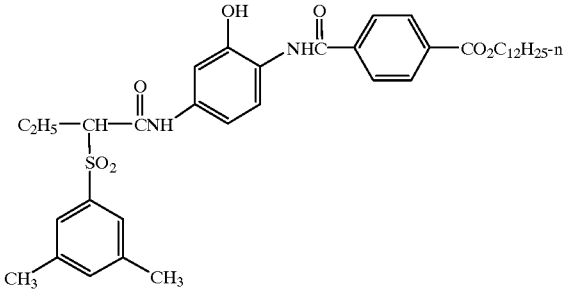
CC-24
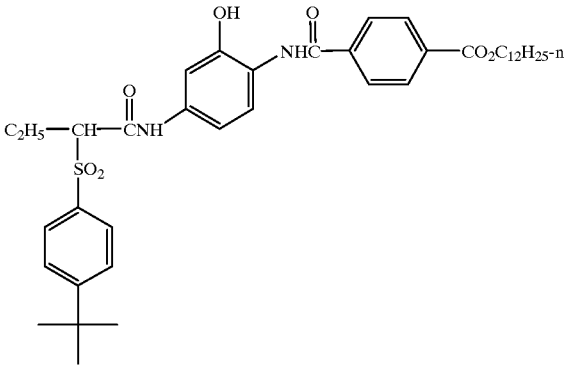
CC-25
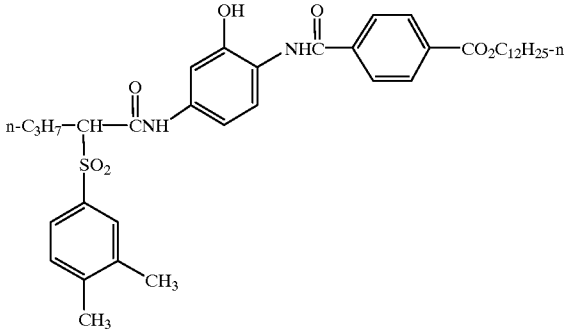

-continued

CC-26

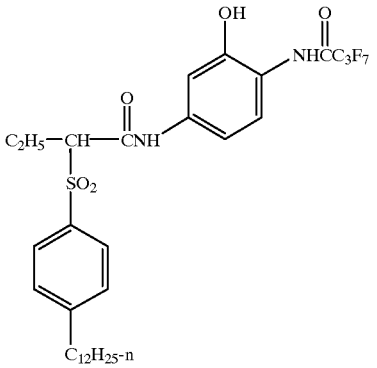

CC-27

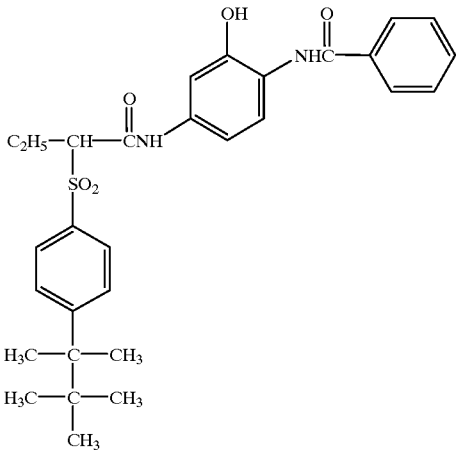

Couplers represented by formulas (MC-I) and (CC-I) of the present invention (to be also simply referred to as "couplers of the present invention" hereinafter) can be introduced to a light-sensitive material by various known dispersion methods. Of these methods, an oil-in-water dispersion method is preferred in which a coupler is dissolved in a high-boiling organic solvent (used in combination with a low-boiling solvent where necessary), the solution is dispersed by emulsification in an aqueous gelatin solution, and the dispersion is added to a silver halide emulsion.

Examples of the high-boiling solvent used in this oil-in-water dispersion method are described in, e.g., U.S. Pat. No. 2,322,027 the disclosure of which is herein incorporated by reference. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104, the disclosures of which are herein incorporated by reference. Dispersion using an organic solvent-soluble polymer is described in PCT International Publication WO88/00723, the disclosure of which is herein incorporated by reference.

Examples of the high-boiling solvent usable in the above-mentioned oil-in-water dispersion method are phthalic acid esters (e.g., dibutylphthalate, dioctylphthalate, dicyclohexylphthalate, bis-2-ethylhexylphthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and bis-2-ethylhexylphenylphosphate), benzoic acid esters (e.g., 2-ethylhexylbenzoate, 2,4-dichlorobenzoate, dodecylbenzoate, and 2-ethylhexyl-p-hydroxybenzoate), amides (e.g., N,N-diethyldodecaneamide, N,N-diethyllaurylamide, and N,N,N,N-tetrakis(2-ehylhexyl) isophthalamide), alcohols and phenols (e.g., isostearylalcohol and 2,4-di-tert-amylphenol), aliphatic esters (e.g., dibutoxyethyl succinate, bis-2-ethylhexyl succinate, 2-hexyldecyl tetradecanoate, tributyl citrate, diethylazelate, isostearyllactate, and trioctyltosylate), aniline derivatives (e.g., N,N-dibutyl-2-butoxy-5-tert-octylaniline), chlorinated paraffins (paraffins containing 10% to 80% of chlorine), trimesic acid esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy)butyric acid and 2-ethoxyoctanedecanic acid), alkylphosphoric acids (e.g., bis-(2-ethylhexyl)phosphoric acid and diphenylphosphoric acid). In addition to the above high-boiling solvents, compounds described in, e.g., JP-A-6-258803, the disclosure of which is herein incorporated by reference, can also be preferably used as high-boiling solvents.

Of these compounds, for the magenta coupler of the invention, phosphoric acid esters and amides and aliphatic esters are preferable, and the combination of these with alcohols or phenols is also preferable.

In addition, for the cyan coupler of the invention, it is preferable to use esters of aromatic carboxylic acids such as phthalic acid esters, and benzoic acid esters, alcohols, phenols or aliphatic esters, or combination of these.

In the present invention, the weight ratio of a high-boiling organic solvent to the coupler of the invention is preferably 0 to 2.0, more preferably, 0 to 1.0, especially preferably, 0 to 0.5, and much more preferably 0.3 or less.

Especially, the weight ratio of a high-boiling organic solvent to the cyan coupler of the invention is preferably 0 to 0.3.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C.

The content of a coupler of the present invention in a light-sensitive material is 0.01 to 10 g, preferably 0.1 g to 2 g per $m^2$. The content is $1\times10^{-3}$ to 1 mol, preferably $2\times10^{-3}$ to $3\times10^{-1}$ mol per mol of a silver halide in the same photosensitive emulsion layer.

When a photosensitive layer has a unit configuration including two or more photosensitive emulsion layers differing in sensitivity, the coupler content of the present invention per mol of a silver halide is preferably $2\times10^{-3}$ to $2\times10^{-1}$ mol in a low-speed layer and $3\times10^{-2}$ to $3\times10^{-1}$ mol in a high-speed layer.

A plurality of couplers represented by formula (MC-I) can be used together, and a plurality of couplers represented by formula (CC-I) can be used together. Also, these couplers can be used together with other couplers. However, the higher the contribution of a color dye of a coupler of the present invention to the total density of dyes which form substantially the same color, the more favorable the obtained results. More specifically, the molar ratio of a coupler of the present invention is preferably 30% or more, more preferably 50% or more, and most preferably 70% or more of the total amount of couplers contained in the light-sensitive material and capable of generating image-forming dyes whose color is in the same color region, i.e., a magenta region or a cyan region.

A light-sensitive material of the present invention can also contain a competing compound (a compound which competes with an image forming coupler to react with the oxidized form of a color developing agent and which does not form any dye image). Examples of this competing coupler are reducing compounds such as hydroquinones, catechols, hydrazines, and sulfonamidophenols, and compounds which couple with the oxidized form of a color developing agent but do not substantially form a color image (e.g., non-dye-forming couplers disclosed in German Patent No. 1,155,675, British Patent No. 861,138, and U.S. Pat. Nos. 3,876,428 and 3,912,513, and couplers such as disclosed in JP-A-6-83002 by which generated dyes flow out during processing steps).

A competing compound is preferably added to a photosensitive emulsion layer containing a coupler of the present invention or a non-photosensitive layer. A competing compound is particularly preferably added to a photosensitive emulsion layer containing a coupler of the present invention. The content of a competing compound is 0.01 to 10 g, preferably 0.10 to 5.0 g per $m^2$ of a light-sensitive material. The content is 1 to 1,000 mol %, preferably 20 to 500 mol % with respect to a coupler of the present invention.

In a light-sensitive material of the present invention, a unit photosensitive layer including a plurality of color-sensitive layers sensitive to the same color can have a non-color-forming interlayer. Additionally, this interlayer preferably contains a compound selectable as the aforementioned competing compound.

To prevent deterioration of the photographic properties caused by formaldehyde gas, a light-sensitive material of the present invention preferably contains compounds described in U.S. Pat. Nos. 4,411,987 and 4,435,503, which can react with and fix formaldehyde gas.

A light-sensitive material of the present invention need only have at least one blue-sensitive silver halide emulsion layer, at least one green-sensitive silver halide emulsion layer, and at least one red-sensitive silver halide emulsion layer on a support. These layers are formed by coating in this order from the one farthest from the support. Also, each color-sensitive layer preferably has a unit configuration including two or more photosensitive emulsion layers differing in speed. In particular, a three-layered unit configuration including three photosensitive emulsion layers, i.e., low-, medium-, and high-speed layers in this order from the one closest to the support is favored.

One preferred embodiment of the present invention is a photosensitive element in which a support is coated with layers in the order of an undercoat layer/antihalation layer/first interlayer/red-sensitive emulsion layer unit (including three layers in the order of a low-speed red-sensitive layer/medium-speed red-sensitive layer/high-speed red-sensitive layer from the one closest to the support)/second interlayer/green-sensitive emulsion layer unit (including three layers in the order of a low-speed green-sensitive layer/medium-speed green-sensitive layer/high-speed green-sensitive layer from the one closest to the support)/third interlayer/yellow filter layer/blue-sensitive emulsion layer unit (including three layers in the order of a low-speed blue-sensitive layer/medium-speed blue-sensitive layer/high-speed blue-sensitive layer from the one closest to the support)/first protective layer/second protective layer.

Each of the first, second, and third interlayers can be a single layer or two or more layers. The first interlayer is preferably divided into two or more layers, and the layer directly adjacent to the red-sensitive layer preferably contains yellow colloidal silver.

Likewise, the second interlayer preferably includes two or more layers, and the layer directly adjacent to the green-sensitive layer preferably contains yellow colloidal silver.

In addition, a fourth interlayer is favorably formed between the yellow filter layer and the blue-sensitive emulsion layer unit.

Also, the protective layer preferably has a three-layered configuration including first to third protective layers. When the protective layer includes two or three layers, the second protective layer preferably contains a fine-grain silver halide having an average equivalent-sphere grain size of 0.10 $\mu$m or less. This silver halide is preferably silver bromide or silver iodobromide.

A silver halide color photographic light-sensitive material of the present invention can have a photosensitive emulsion layer other than those enumerated above. It is particularly preferable, in respect of color reproduction, to form a photosensitive emulsion layer spectrally sensitized to a cyan region to give an interlayer effect to a red-sensitive emulsion layer. This layer for imparting an interlayer effect can be blue-, green-, or red-sensitive.

Processing steps favorably used for a color photographic light-sensitive material of the present invention will be described below.

The present invention is preferably applied to color reversal processing in which black-and-white development and color development are performed in this order.

Black-and-white development (first development) as the first step will be explained.

As a black-and-white developer, any conventionally known developing agent can be used. Examples of the developing agent are dihydroxybenzenes (e.g., hydroquinone and hydroquinone monosulfonate), 3-pyrazolidones (e.g., 1-phenyl-3-pyrazolidone and 1-phenyl-4-methyl-4-hydroxymethyl-3-pyrazolidone), aminophenols (e.g., N-methyl-p-aminophenol and N-methyl-3-methyl-p-aminophenol), and ascorbic acid and its isomer or derivative. These developing agents can be used singly or together. A preferred developing agent is potassium hydroquinone monosulfonate or sodium hydroquinone monosulfonate. The addition amount of these developing agents is about $1\times10^{-5}$ to 2 mols/liter (to be also abbreviated as "L" hereinafter) per L of a developer.

The black-and-white developer of the present invention can contain a preservative where necessary. As this preservative, sulfite or bisulfite is generally used. The addition amount is 0.01 to 1 mol/L, preferably 0.1 to 0.5 mol/L. Ascorbic acid is also an effective preservative, and its favored addition amount is 0.01 to 0.5 mol/L. It is also possible to use hydroxylamines represented by formula (I) in JP-A-3-144446, sugars, o-hydroxyketones, and hydrazines. The addition amount of these preservatives is 0.1 mol/L or less.

The pH of the black-and-white developer of the present invention is preferably 8 to 12 and most preferably 9 to 11. Various buffering agents can be used to maintain this pH. Preferred examples of the buffering agents are carbonate, phosphate, borate, 5-sulfosalicylate, hydroxybenzoate, glycine salt, N,N-dimethylglycine salt, leucine salt, norleucine salt, guanine salt, 3,4-dihydroxyphenylalanine salt, alanine salt, aminobutyrate, valine salt, and lycine salt. Carbonate, borate, and 5-sulfosalicylate are particularly preferred because they can keep the above-mentioned pH range and are inexpensive. These buffering agents can be used singly, and two or more types of them can be used together. To obtain a target pH, an acid and/or an alkali can be added.

As an acid, inorganic and organic water-soluble acids can be used. Examples are sulfuric acid, nitric acid, hydrochloric acid, acetic acid, propionic acid, and ascorbic acid. As an alkali, various hydroxides and ammonium salt can be added. Examples are potassium hydroxide, sodium hydroxide, ammonia water, triethanolamine, and diethanolamine.

The black-and-white developer used in the present invention preferably contains a silver halide solvent as a development accelerator. Favored examples are thiocyanate, sulfite, thiosulfate, 2-methylimidazole, and a thioether-based compound described in JP-A-57-63580. The addition amount of these compounds is preferably about 0.005 to 0.5 mol/L.

Other examples of the development accelerator are various quaternary amines, polyethyleneoxides, 1-phenyl-3-pyrazolidones, primary amines, and N,N,N',N'-tetramethyl-p-phenylenediamine.

The black-and-white developer used in the present invention can also contain diethylene glycol, propylene glycol, polyethylene glycols, and amines such as diethanolamine and triethanolamine, as dissolution assistants; quaternary ammonium salt as a sensitizer; and various surfactants and film hardeners.

In the black-and-white development step of the present invention, various antifoggants can be added to prevent development fog. Preferred examples are alkali metal halides such as sodium chloride, potassium chloride, potassium bromide, sodium bromide, and potassium iodide, and organic antifoggants. As organic antifoggants, it is possible to use nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, and hydroxyazaindolizine, mercapto-substituted heterocyclic compounds such as 1-phenyl-5-mercaptotetrazole, 2-mercaptobenzoimidazole, and 2-mercaptobenzothiazole, and mercapto-substituted aromatic compounds such as thiosalicylic acid. These antifoggants include those which flow out from a color reversal light-sensitive material during processing and build up in the developer for the light-sensitive material.

Of these compounds, the addition concentration of an iodide is about $5\times10^{-6}$ to $5\times10^{-4}$ mol/L. A bromide is also favorable to prevent fog. The concentration of a bromide is preferably 0.001 to 0.1 mol/L and more preferably about 0.01 to 0.05 mol/L.

In addition, the black-and-white developer of the present invention can contain swell inhibitors (e.g., inorganic salts such as sodium sulfate and potassium sulfate) and water softeners.

As water softeners, it is possible to user various structures such as aminopolycarboxylic acid, aminopolyphosphonic acid, phosphonocarboxylic acid, and organic and inorganic phosphonic acids. Although practical examples are presented below, water softeners are not restricted to these examples.

Ethylenediaminetetraacetic acid, nitrilotriacetic acid, hydroxyethyliminodiacetic acid, propylenediaminetetraacetic acid, diethylenetriaminepentaacetic acid, triethylenetetraminehexaacetic acid, nitrilo-N,N,N-trimethylenephosphonic acid, ethylenediamine-N,N,N',N'-tetramethylenephosphonic acid, and 1-hydroxyethylidene-1,1-diphosphonic acid. Two or more types of these water hardeners can be used together. The addition amount is favorably 0.1 to 20 g/L and more favorably 0.5 to 10 g/L.

The standard processing time of black-and-white development is 6 min, and sensitization and desensitization can be performed by appropriately changing this processing time. The processing time is usually changed between 2 and 18 min. The processing temperature is 20° C. to 50° C., preferably 33° C. to 45° C. The replenishment rate of the black-and-white developer is 100 to 5,000 milliliters (to be also abbreviated as "mL" hereinafter), preferably about 200 to 2,500 mL per $m^2$ of a light-sensitive material.

In the processing of the present invention, a light-sensitive material is washed and/or rinsed as needed after black-and-white development. After that, the material is processed in a reversal processing step and subsequently color-developed.

A washing bath or rinsing bath can be a single bath. However, it is more favorable to use a multistage counter-flow system using two or more tanks, in order to reduce the replenishment rate. "Washing" is a method by which a relatively large amount of water is replenished; "rinsing" is a method by which the replenishment rate is reduced to the level of other processing baths. The replenishment rate of the washing water is preferably about 3 to 20 L per $m^2$ of a light-sensitive material. The replenishment rate of the rinsing bath is preferably 50 mL to 2 L and more preferably about 100 to 500 mL; the use amount of water is greatly reduced compared to the washing step.

Also, to the rinsing bath of the present invention, it is possible to add, e.g., an oxidizer, chelating agent, buffering agent, germicide, and brightening agent as needed.

Subsequently, the material enters a reversal bath or a photo-fogging step. In the reversal bath, known fogging agents can be used as chemical fogging agents. Examples are stannous ion complex salts such as stannous ion-organic phosphoric acid complex salt (U.S. Pat. No. 3,617,282), stannous ion organic phosphonocarboxylic acid complex salt (JP-B-56-32616), and stannous ion-aminopolycarboxylic acid complex salt (U.S. Pat. No. 1,209,050); stannous ion complex salt of a chelating agent represented by formula (II) or (III) in JP-A-11-109573; and boron compounds such as a hydrogenated boron compound (U.S. Pat. No. 2,984,567) and a heterocyclic amineborane compound (British Patent No. 1,011,000). The pH of the reversal bath extends over a broad range from an acidic to an alkaline side in accordance with the type of fogging agent. This pH is usually 2 to 12, often 2.5 to 10, and most often 3 to 9.

The concentration of tin(II) in the reversal bath is $1\times10^{-3}$ to $5\times10^{-2}$ mol/L, preferably $2\times10^{-3}$ to $1.5\times10^{-2}$ mol/L.

To increase the solubility of the tin(II) chelate, the reversal bath preferably contains propionic acid, acetic acid, or an alkylenedicarboxylic acid compound represented by formula (I) in JP-A-11-109572. In addition, the reversal bath favorably contains sorbic acid salt and a quaternary ammonium compound described in U.S. Pat. No. 5,811,225 as antibacterial agents.

The time of the reversal bath is 10 sec to 3 min, preferably 20 sec to 2 min, and more preferably 30 to 90 sec. The temperature of the reversal bath is preferably at the temperature of any of first development, those of the subsequent rinsing or washing and color development, or within the temperature range of these bathes. This temperature is generally 20 to 50° C. and preferably 33 to 45° C.

The replenishment rate of the reversal bath is 10 to 2,000 mL, favorably 200 to 1,500 mL per $m^2$ of a light-sensitive material.

The tin(II) chelate of the reversal bath achieves its effects over a wide pH range, so it is not particularly necessary to add another pH buffering agent. However, this does not prevent addition of acids, alkalis, and salts for imparting pH buffering properties. Examples are organic acids such as citric acid and malic acid, inorganic acids such as boric acid, sulfuric acid, and hydrochloric acid, alkali carbonate, caustic, borax, and potassium metaborate. It is also possible, if necessary, to add a water softener such as aminopolycarboxylic acid, a swell inhibitor such as sodium sulfate, and an antioxidant such as p-aminophenol.

After being processed in the reversal bath, the material enters a color development step. A color developer used in color development of the present invention is an alkaline aqueous solution containing an aromatic primary amine color developing agent as its main constituent. As this color developing agent, a p-phenylenediamine compound is preferably used. Representative examples of this p-phenylenediamine compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, their sulfates, hydrochlorides, and phosphates, p-toluenesulfonate, tetraphenylborate, and p-(t-octyl)benzenesulfonate. Two or more types of these developing agents can be used together where necessary. The addition amount is preferably 0.005 to 0.1 mol/L and more preferably about 0.01 to 0.05 mol/L.

The pH of the color developer of the present invention is favorably 11.5 to 13 and most favorably 11.7 to 12.3. Various buffering agents are used to maintain this pH.

As a buffering agent having a buffering region in the pH range used in the present invention, it is possible to use carbonate, phosphate, borate, 5-sulfosalicylate, tetraborate, hydroxybenzoate, glycine salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt, and lycine salt. In particular, carbonate, borate, and 5-sulfosalicylate have advantages that they have high solubility and high buffering capacity in a high pH region of pH 11.5 or more, have no adverse effect (e.g., stain) on photographic properties even when added to a color developer, and are inexpensive. Hence, the use of these buffering agents is particularly preferred.

Practical examples of these buffering agents are sodium carbonate, potassium carbonate, sodium bicarbonate, potassium bicarbonate, trisodium phosphate, tripotassium phosphate, disodium phosphate, dipotassium phosphate, dipotassium 5-sulfosalicylate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). Preferred examples are trisodium phosphate, tripotassium phosphate, disodium phosphate, dipotassium phosphate, dipotassium 5-sulfosalicylate, and disodium 5-sulfosalicylate.

These buffering agents can be singly added to the developer, and two or more types of them can be added together. Consequently, a target pH can be obtained by an alkali agent or an acid.

The amount of buffering agents added to the color developer is preferably 0.1 mol/L or more and particularly preferably 0.1 to 0.4 mol/L (as a total amount when they are used together).

In the present invention, various development accelerators can also be used as needed.

As development accelerators, it is possible to use diverse pyridinium compounds represented by U.S. Pat. No. 2,648,604, JP-B-44-9503, and U.S. Pat. No. 3,171,247 and other cationic compounds, cationic dyes such as phenosafranine, neutral salts such as thallium nitrate and potassium nitrate, polyethylene glycols and its derivatives described in JP-B-44-9304, U.S. Pat. Nos. 2,533,990, 2,531,832, 2,950,970, and 2,577,127, nonionic compounds such as polythioethers, and thioether-based compounds described in U.S. Pat. No. 3,201,242.

In addition, benzyl alcohol and its solvents, e.g., diethylene glycol, triethanolamine, and diethanolamine can be used where necessary. However, the use of these compounds is preferably as minimum as possible when the environmental load, the solubility of a solution, and the generation of tar are taken into consideration.

A silver halide solvent similar to that of a black-and-white developer can also be contained. Examples are thiocyanate, 2-methylimidazole, and a thioether-based compound described in JP-A-57-63580. 3,6-dithiaoctane-1,8-diol is particularly favored.

In the color development step of the present invention, development fog need not be prevented. However, when running is performed while a color film is replenished, various antifoggants can also be contained to maintain the composition of a solution and the constancy of performance. Preferred examples of the antifoggants used in the development step are alkali metal halides such as potassium chloride, sodium chloride, potassium bromide, sodium bromide, and potassium iodide, and organic antifoggants. As organic antifoggants, it is possible to use nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, and hydroxyazaindolizine, mercapto-substituted heterocyclic compounds such as 1-phenyl-5-mercaptotetrazole, 2-mercaptobenzimidazole, and 2-mercaptobenzothiazole, and mercapto-substituted aromatic compounds such as thiosalicylic acid. These antifoggants include those which flow out of a color reversal light-sensitive material during processing and build up in these developers.

Various preservatives can be used in the color developer according to the present invention.

Representative preservatives are hydroxylamines and sulfite, and sulfite is preferred. The addition amount of these preservatives is about 0 to 0.1 mol/L.

The color developer used in the present invention can contain organic preservatives instead of hydroxylamines and sulfurous acid ion described above.

"Organic preservatives" mean general organic compounds which reduce the deterioration rate of the aromatic primary amine color developing agent when added to a processing solution of a color photographic light-sensitive material. That is, organic preservatives are organic compounds having a function of preventing oxidation of the color developing agent by air and the like. Particularly effective organic preservatives are hydroxylamine derivatives (except for hydroxylamine), hydroxamic acids, hydrazines, hydrazides, phenols, α-hydroxyketones, α-aminoketones, sugars, monoamines, diamines, polyamines, quaternary ammonium salts, nitroxy radicals, alcohols, oximes, dialed compounds, and condensed-ring amines. These preservatives are disclosed in, e.g., JP-B-48-30496, JP-A's-52-143020, 63-4235, 63-30845, 63-21647, 63-44655, 63-53551, 63-43140, 63-56654, 63-58346, 63-43138, 63-146041, 63-44657, and 63-44656, U.S. Pat. Nos. 3,615,503 and 2,494,903, and JP-A's-1-97953, 1-186939, 1-186940, 1-187557, and 2-306244. As other preservatives, it is also possible to use, if necessary, various metals described in JP-A's-57-44148 and 57-53749, salicylic acids described in JP-A-59-180588, amines described in JP-A's-63-239447, 63-128340, 1-186939, and 1-187557, alkanolamines described in JP-A-54-3532, polyethyleneimines described in JP-A-56-94349, and aromatic polyhydroxy compounds described in U.S. Pat. No. 3,746,544. It is particularly preferable to add alkanolamines such as triethanolamine, dialkylhydroxylamine such as N,N-diethylhydroxylamine or N,N-di(sulfoethyl)hydroxylamine, a hydrazine derivative (except for hydrazine) such as N,N-bis(carboxymethyl)hydrazine, or an aromatic polyhydroxy compound represented by soda catechol-3,5-disulfonate.

The addition amount of these organic preservatives is preferably 0.02 to 0.5 mol/L and more preferably about 0.05 to 0.2 mol/L. Two or more types of these organic preservatives can be used together if necessary.

In addition, the color developer according to the present invention can contain organic solvents such as diethylene glycol and triethylene glycol; dye forming couplers; competing couplers such as citrazinic acid, J acid, and H acid; nucleating agents such as sodium boron hydride; auxiliary developing agents such as 1-phenyl-3-pyrazolidone; viscosity imparting agents; and chelating agents such as aminopolycarboxylic acids represented by ethylenediaminetetraacetic acid, nitrilotriacetic acid, cyclohexanediaminetetraacetic acid, hydroxyethyliminodiacetic acid, iminodiacetic acid, N-hydroxymethylethylenediaminetriacetic acid, diethylenetriaminepentaacetic acid, triethylenetetraminehexaacetic acid, and a compound described in JP-A-58-195845, 1-hydroxyethylidene-1,1'-diphosphonic acid, organic phosphonic acid described in Research Disclosure No. 18170 (May 1979), aminophosphonic acids such as aminotris (methylenephosphonic acid) and ethylenediamine-N,N,N', N'-tetramethylenephosphonic acid, and phosphonocarboxylic acids described in JP-A's-52-102726, 53-42730, 54-121127, 55-4024, 55-4025, 55-126241, 55-65955, 55-65956, and Research Disclosure No. 18170 (May 1979). The addition amount of these chelating agents is 0.05 to 20 g/L, preferably about 0.1 to 5 g/L. Two or more types of these chelating agents can be used together where necessary.

It is also possible to add, as needed, various surfactants such as alkylsulfonic acid, arylsulfonic acid, aliphatic carboxylic acid, and aromatic carboxylic acid polyalkyleneimine.

The processing temperature of the color developer applicable to the present invention is 20 to 50° C., preferably 33 to 45° C. The processing time is 20 sec to 5 min, preferably 20 sec to 4 min. The replenishment rate is preferably as small as possible provided that the activity can be maintained. This replenishment rate is appropriately 100 to 2,500 mL and preferably 400 to 1,200 mL per $m^2$ of a light-sensitive material.

The color-developed color reversal light-sensitive material is subsequently desilvered. This desilvering process is usually done by the following steps.

1. (Color development)—adjustment—bleaching—fixing
2. (Color development)—washing—bleaching—fixing
3. (Color development)—bleaching—fixing
4. (Color development—washing—bleaching—washing—fixing
5. (Color development)—bleaching—washing—fixing
6. (Color development)—washing—bleach-fix
7. (Color development)—adjustment—bleach-fix
8. (Color development)—bleach—fixing
9. (Color development)—washing—bleaching—bleach-fix
10. (Color development)—bleaching—bleach-fix
11. (Color development)—washing—bleaching—bleach-fix—fixing Of the above processes, 1, 3, and 7 are preferred.

In the above processes, the replenisher of each bath can be replenished to the corresponding bath as in conventional methods. In processes 9 and 10, it is possible to introduce an overflow solution of the bleaching solution to the bleach-fix bath and replenish only the fixing solution composition to the bleach-fix bath. In process 11, it is possible to use a method by which an overflow solution of the bleaching solution is introduced to the bleach-fix solution, an overflow solution of the fixing solution is introduced to the bleach-fix solution, and the two solutions are caused to overflow from the bleach-fix bath.

As a bleaching agent of the bleaching bath or the bleach-fix bath of the present invention, the currently most generally used is aminopolycarboxylic acid iron(III) complex salt. Representative examples of these aminopolycarboxylic acids and their salts are:

A-1 Ethylenediaminetetraacetic acid
A-2 Ethylenediaminetetraacetic acid disodium salt
A-3 Ethylenediaminetetraacetic acid diammonium salt
A-4 Diethylenetriaminepentaacetic acid
A-5 Cyclohexanediaminetetraacetic acid
A-6 Cyclohexanediaminetetraacetic acid disodium salt
A-7 Iminodiacetic acid
A-8 1,3-diaminopropane tetraacetic acid
A-9 Methyliminodiacetic acid
A-10 Hydroxyethyliminodiacetic acid
A-11 Glycoletherdiaminetetraacetic acid
A-12 Ethylenediaminetetrapropionic acid
A-13 N-(2-carboxyethyl)-iminodiacetic acid
A-14 Ethylenediaminedipropionic acid
A-15 β-alaninediacetic acid
A-16 Ethylenediaminedimalonic acid
A-17 Ethylenediaminedisuccinic acid
A-18 Propylenediaminedisuccinic acid Aminopolycarboxylic acid ferric complex salt can be used in the form of complex salt, or ferric ion complex salt can be formed in a solution by using ferric salt and aminopolycarboxylic acid. In addition, one type or two or more types of aminopolycarboxylic acids can be used. In either case, aminocarboxylic acid more than necessary to form ferric ion complex salt can be used.

The bleaching solution or bleach-fix solution containing the above ferric ion complex can also contain metal ion complex salt, such as cobalt or copper, other than iron.

The addition amount of these bleaching agents is 0.02 to 0.5 mol, preferably 0.05 to 0.3 mol per L of a bath having bleaching capacity.

Various bleach-fix accelerators can be added to the bleaching bath and bleach-fix bath of the present invention.

Examples of these bleaching accelerators are diverse mercapto compounds as described in U.S. Pat. No. 3,893,858, British Patent No. 1,138,842, and JP-A-53-141623, compounds having a disulfide bond as described in JP-A-

53-95630, thiazolidine derivatives as described in JP-B-53-9854, isothiourea derivatives as described in JP-A-53-94927, thiourea derivatives as described in JP-B's-45-8506 and 49-26586, and thioamide compounds as described in JP-A-49-42349, and dithiocarbamates as described in JP-A-55-26506.

As a bleaching accelerator, it is also possible to use an alkylmercapto compound which is either unsubstituted or substituted by, e.g., a hydroxyl group, carboxyl group, sulfonic acid, or amino group (which can have a substituent such as an alkyl group or an acetoxyalkyl group). Examples are trithioglycerin, α,α'-thiodipropionic acid, and δ-mercaptobutyric acid. Furthermore, compounds described in U.S. Pat. No. 4,552,834 can be used.

The addition amount when a compound having a mercapto group or disulfide bond in the above molecule, a thiazoline derivative, or an isothiourea derivative is to be contained in an adjusting solution or a bleaching solution changes in accordance with, e.g., the type of photographic material to be processed, the processing temperature, and the time required for target processing. However, this amount is appropriately $1\times10^{-5}$ to $10^{-1}$ mol and preferably $1\times10^{-4}$ to $5\times10^{-2}$ mol per L of a processing solution.

In addition to the bleaching agents and compounds described above, the bleaching solution used in the present invention can contain a rehalogenating agent, e.g., a bromide such as potassium bromide, sodium bromide, or ammonium bromide, or a chloride such as potassium chloride, sodium chloride, or ammonium chloride. Furthermore, known additives commonly used in a bleaching solution can be added to the bleaching solution of the present invention. Examples of these additives are one or more types of inorganic acids, organic acids, and their salts having pH buffering capacity. Practical examples are nitrate such as sodium nitrate and ammonium nitrate, boric acid, borax, sodium metaborate, acetic acid, sodium acetate, sodium carbonate, potassium carbonate, phosphorous acid, phosphoric acid, sodium phosphate, citric acid, sodium citrate, and tartaric acid.

The pH of a solution having bleaching capacity is preferably 4.0 to 8.0 and particularly preferably 5.0 to 7.0 when in use.

In the bleach-fix solution, one type or two or more types of water-soluble silver halide dissolving agents can be mixed as fixing agents. Examples are thiosulfate such as sodium thiosulfate and ammonium thiosulfate, thiocyanate such as sodium thiocyanate, ammonium thiocyanate, and potassium thiocyanate, thioether compounds such as ethylenebisthioglycolic acid and 3,6-dithia-1,8-octanediol, and thioureas. It is also possible to use a special bleach-fix solution, described in JP-A-55-155354, which is the combination of a fixing agent and a large amount of a halide such as potassium iodide. The amount of these fixing agents is 0.1 to 3 mols, preferably 0.2 to 2 mols per L of a bath having fixing capacity.

When a fixing solution is used in the present invention, its fixing agents can also be known fixing agents, i.e., water-soluble silver halide dissolving agents. Examples are thiosulfate such as sodium thiosulfate and ammonium thiosulfate, thiocyanate such as sodium thiocyanate, ammonium thiocyanate, and potassium thiocyanate, thioether compounds such as ethylenebisthioglycolic acid and 3,6-dithia-1,8-octanediol, and thioureas. One type or two or more types of these fixing agents can be mixed. The concentration of the fixing agent is 0.1 to 3 mols, preferably 0.2 to 2 mols per L of the fixing solution.

In addition to the aforementioned additives, a solution having fixing capacity can contain preservatives such as sulfite (e.g., sodium sulfite, potassium sulfite, and ammonium sulfite), bisulfite, hydroxylamine, hydrazine, and a bisulfite adduct of an aldehyde compound (e.g., sodium acetaldehyde bisulfite). Sulfinic acids (e.g., benzenesulfinic acid) and ascorbic acid are also effective preservatives.

Furthermore, a solution having bleaching capacity can contain various brightening agents, anti-foaming agents, surfactants, polyvinylpyrrolidone, antibacterial agents, antifungal agents, and organic solvents such as methanol.

The replenishment rate of each of the bleaching solution, fixing solution, bleach-fix solution, and the like in the present invention can be arbitrarily set as long as the functions of these processing baths are satisfied. The replenishment rate is preferably 30 to 2,000 mL and more preferably 50 to 1,000 mL per $m^2$ of a light-sensitive material.

The processing temperature is preferably 20° C. to 50° C. and more preferably 33° C. to 45° C. The processing time is 10 sec to 10 min, preferably 20 sec to 6 min.

After the desilvering process such as fixing or bleach-fix, washing and/or stabilization is generally performed. Although a stabilizing solution usually contains an image stabilizer, a stabilizing solution not containing any image stabilizer can also be used. A solution like this is sometimes called a rinsing solution (cleaning solution), in distinction from a stabilizing solution.

The amount of water used in the washing step can be set over a broad range in accordance with the characteristics (e.g., characteristics determined by materials used such as couplers) and the intended use of a light-sensitive material, the temperature of the water, the number of water tanks (the number of stages), and other diverse conditions. The relationship between the amount of water and the number of water tanks in the multistage countercurrent system can be obtained by a method described in "Journal of the Society of Motion Picture and Television Engineering", Vol. 64, pp. 248–253 (May, 1955). In the multistage countercurrent system, the number of stages is preferably 2 to 15 and particularly preferably 2 to 10.

By the multistage countercurrent system, the amount of washing water can be greatly decreased. Since washing water stays in the tanks for long periods of time, however, bacteria multiply and the floating substances produced attach to a light-sensitive material. To solve this problem, a method of reducing calcium and magnesium ions described in JP-A-62-288838 can be extremely effectively used. It is also possible to use an isothiazolone compound and cyabendazoles described in JP-A-57-8542, a chlorine-based germicide such as chlorinated sodium isocyanurate described in JP-A-61-120145, benzotriazole described in JP-A-61-267761, copper ion, and germicides described in Hiroshi Horiguchi et al., "Antibacterial and Antifungal Chemistry" (1986), Sankyo Shuppan, Eiseigijutsu-Kai ed., "Sterilization, Antibacterial, and Antifungal Techniques for Microorganisms" (1982), KogyogijutsuKai, and Nippon Bokin Bokabi Gakkai ed., "Dictionary of Antibacterial and Antifungal Agents" (1986).

Also, it is possible to add aldehydes, such as formaldehyde, acetaldehyde, and pyruvaldehyde, for preventing discoloration of a dye or generation of stain by inactivating a residual magenta coupler, methylol compounds and hexamethylenetetramine described in U.S. Pat. No. 4,786,583, hexahydrotriazines described in JP-A-2-153348, formaldehyde bisulfite adducts described in U.S. Pat. No. 4,921,779, and azolylmethylamines described in European Patent Publication Nos. 504609 and 519190.

To reduce contamination and unevenness on the processed film surface, it is favorable to add an image stabilizer or its precursor to an adjusting solution and not to add any such image stabilizer to a stabilizing solution (rinsing solution), as described in U.S. Pat. Nos. 4,960,687, 4,975,356, and 5,037,725.

Furthermore, a surfactant as a hydro-extracting agent and a chelating agent represented by EDTA as a water softener can be used in washing water, a stabilizing solution, or a rinsing solution.

Examples of the surfactant are a polyethylglycol type nonionic surfactant, polyvalent alcohol type nonionic surfactant, alkylbenzenesulfonate type anionic surfactant, higher alcohol sulfate type anionic surfactant, alkylnaphthalenesulfonate type anionic surfactant, quaternary ammonium salt type cationic surfactant, amine salt type cationic surfactant, amino salt type amphoteric surfactant, and betaine type amphoteric surfactant. Two or more types of these surfactants can be used together. A fluorine-based surfactant or siloxane-based surfactant described in U.S. Pat. No. 5,716,765 can also be used.

Of the nonionic surfactants, alkylpolyethyleneoxides, alkylphenoxypolyethyleneoxides, and alkylphenoxypolyhydroxypropyleneoxides are preferred. A particularly preferred nonionic surfactant is 8- to 15-carbon, alkylpolyethyleneoxide (5 to 12) alcohol.

To improve the solubility of a surfactant, it is also preferable to add solubilizers, e.g., amines such as diethanolamine and triethanolamine, and glycols such as diethylene glycol and propylene glycol.

It is preferable that chelating agents for collecting heavy metals be contained in the stabilizing solution or rinsing solution of the present invention, in order to improve the stability of the solution and reduce contamination. As chelating agents, the same compounds as added to the developer and the bleaching solution described above can be used.

To prevent mildew of bacteria, it is preferable to add antibacterial and antifungal agents to the stabilizing solution or rinsing solution of the present invention. For this purpose, commercially available antibacterial and antifungal agents can be used. Furthermore, surfactants, brightening agents, and film hardeners can be added.

The pH of the stabilizing solution, rinsing solution, and washing water of the present invention is 4 to 9, preferably 5 to 8. The processing temperature and the processing time can also be variously set in accordance with the characteristics and the intended use of a light-sensitive material. In general, the processing temperature and the processing time are 15 to 45° C. and 20 sec to 10 min, preferably 25 to 40° C. and 30 sec to 2 min, respectively. Furthermore, the contamination preventing effect of the stabilizing solution or rinsing solution of the present invention significantly appears when processing is performed using the stabilizing solution or rinsing solution immediately after the desilvering process without performing washing.

The replenishment rate of the stabilizing solution or rinsing solution of the present invention is preferably 200 to 2,000 ml per $m^2$ of a light-sensitive material. The overflow solutions produced by replenishment of the washing water and/or the stabilizing solution can also be reused in other steps such as the desilvering step.

To reduce the use amount of the washing water, ion exchange or ultrafiltration can be used. The use of ultrafiltration is particularly preferred. Various processing solutions of the present invention are used at 10° C. to 50° C. Although a temperature of 33° C. to 38° C. is usually a standard temperature, the processing time can be shortened by encouraging the processing by raising the temperature. Conversely, it is possible to improve the image quality or the stability of a processing solution by lowering the temperature.

In the processing of a light-sensitive material according to the method of the present invention, when stabilization is to be immediately performed without any washing step, any known methods described in, e.g., JP-A's-57-8543, 58-14834, and 60-220345 can be used.

It is also favorable to use chelating agents such as 1-hydroxyethylidene-1,1-diphosphonic acid and ethylenediaminetetramethylenephosphonic acid, magnesium, and a bismuth compound.

Drying is performed following the washing and/or the stabilization step. To reduce the amount of water carried to an image film, drying can be accelerated by absorbing water by squeeze rollers or cloth immediately after the washing bath. Drying can also be naturally accelerated by improving the dryer, e.g., by increasing the temperature or strengthening the drying air by changing the shape of spray nozzles. In addition, as described in JP-A-3-157650, drying can be accelerated by adjusting the angle at which air is supplied to a light-sensitive material or improving a method of exhausting the air.

Applicable various techniques and inorganic and organic materials usable in the silver halide photographic material and silver halide emulsions used therein are generally those described in Research Disclosure Item 308119 (1989), Item 37038 (1995), and Item 40145 (1997), the disclosures of which are incorporated herein by reference.

In addition, more specifically, techniques and inorganic and organic materials that can used in the color photosensitive materials of the present invention are described in portions of EP436,938A2 and patents cited below, the disclosures of which are incorporated herein by reference.

| Items | Corresponding portions |
|---|---|
| 1) Layer configurations | page 146, line 34 to page 147, line 25 |
| 2) Silver halide emulsions usable together | page 147, line 26 to page 148 line 12 |
| 3) Yellow couplers usable together | page 137, line 35 to page 146, line 33, and page 149, lines 21 to 23 |
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 to page 29, line 50 |
| 9) Antiseptic and mildewproofing agents | page 150, lines 25 to 28 |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |

-continued

| Items | Corresponding portions |
|---|---|
| 14) Film thickness. film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing.stabilizing step | page 153, lines 3 to 37 |

EXAMPLE-1

The present invention will be described in detail below by way of its examples, but the invention is not limited to these examples.

Preparation of Sample 101

A multilayered color light-sensitive material including layers having the following compositions was formed on a 127-μm thick undercoated cellulose triacetate film support to make a sample 101. Numbers represent addition amounts per $m^2$. Note that the effects of added compounds are not restricted to the described purposes.

| | | |
|---|---|---|
| **1st layer: Antihalation layer** | | |
| Black colloidal silver | | 0.25 g |
| Gelatin | | 2.40 g |
| Ultraviolet absorbent U-1 | | 0.10 g |
| Ultraviolet absorbent U-3 | | 0.10 g |
| Ultraviolet absorbent U-4 | | 0.10 g |
| High-boiling organic solvent Oil-1 | | 0.050 g |
| High-boiling organic solvent Oil-2 | | 0.050 g |
| High-boiling organic solvent Oil-5 | | 0.010 g |
| Dye D-4 | | 1.0 mg |
| Dye D-8 | | 2.5 mg |
| Fine-crystal solid dispersion of dye E-1 | | 0.05 g |
| **2nd layer: Interlayer** | | |
| Gelatin | | 0.50 g |
| Compound Cpd-A | | 0.2 mg |
| Compound Cpd-K | | 3.0 mg |
| Compound Cpd-M | | 0.030 g |
| Ultraviolet absorbent U-6 | | 6.0 mg |
| High-boiling organic solvent Oil-3 | | 0.010 g |
| High-boiling organic solvent Oil-4 | | 0.010 g |
| High-boiling organic solvent Oil-7 | | 2.0 mg |
| Dye D-7 | | 4.0 mg |
| **3rd layer: Interlayer** | | |
| Yellow colloidal silver | | 0.020 g |
| Gelatin | | 0.60 g |
| Compound Cpd-M | | 0.010 g |
| Compound Cpd-D | | 0.020 g |
| High-boiling organic solvent Oil-3 | | 0.010 g |
| **4th layer: Low-speed red-sensitivie emulsion layer** | | |
| Emulsion A | silver | 0.10 g |
| Emulsion B | silver | 0.20 g |
| Emulsion C | silver | 0.20 g |
| Gelatin | | 0.70 g |
| Coupler C-1 | | 0.12 g |
| Ultraviolet absorbent U-3 | | 0.010 g |
| Compound Cpd-I | | 0.020 g |
| Compound Cpd-J | | 2.0 mg |
| High-boiling organic solvent Oil-2 | | 0.050 g |

-continued

| | | |
|---|---|---|
| Additive P-1 | | 0.020 g |
| **5th layer: Medium-speed red-sensitive emulsion layer** | | |
| Emulsion C | silver | 0.25 g |
| Emulsion D | silver | 0.15 g |
| Emulsion E | silver | 0.10 g |
| Gelatin | | 1.00 g |
| Coupler C-1 | | 0.10 g |
| Coupler C-2 | | 0.10 g |
| Ultraviolet absorbent U-3 | | 0.010 g |
| High-boiling organic solvent Oil-2 | | 0.070 g |
| Additive P-1 | | 0.020 g |
| **6th layer: High-speed red-sensitive emulsion layer** | | |
| Emulsion F | silver | 0.55 g |
| Gelatin | | 1.70 g |
| Coupler C-3 | | 0.80 g |
| Ultraviolet absorbent U-1 | | 0.010 g |
| Ultraviolet absorbent U-2 | | 0.010 g |
| High-boiling organic solvent Oil-2 | | 0.030 g |
| Compound Cpd-L | | 1.0 mg |
| Additive P-1 | | 0.10 g |
| **7th layer: Interlayer** | | |
| Gelatin | | 1.00 g |
| Additive P-2 | | 0.10 g |
| Compound Cpd-I | | 0.010 g |
| Dye D-5 | | 0.020 g |
| Dye D-9 | | 6.0 mg |
| Compound Cpd-M | | 0.040 g |
| Compound Cpd-O | | 3.0 mg |
| Compound Cpd-P | | 5.0 mg |
| High-boiling organic solvent Oil-6 | | 0.050 g |
| **8th layer: Interlayer** | | |
| Yellow colloidal silver | silver | 0.020 g |
| Gelatin | | 1.20 g |
| Additive P-2 | | 0.05 g |
| Ultraviolet absorbent U-1 | | 0.010 g |
| Ultraviolet absorbent U-3 | | 0.010 g |
| Compound Cpd-A | | 0.050 g |
| Compound Cpd-D | | 0.030 g |
| Compound Cpd-M | | 0.050 g |
| High-boiling organic solvent Oil-3 | | 0.010 g |
| High-boiling organic solvent Oil-6 | | 0.050 g |
| **9th layer: Low-speed green-sensitive emulsion layer** | | |
| Emulsion G | silver | 0.20 g |
| Emulsion H | silver | 0.35 g |
| Emulsion I | silver | 0.35 g |
| Gelatin | | 1.50 g |
| Coupler C-7 | | 0.20 g |
| Compound Cpd-B | | 0.030 g |
| Compound Cpd-D | | 5.0 mg |
| Compound Cpd-E | | 5.0 mg |
| Compound Cpd-G | | 2.5 mg |
| Compound Cpd-F | | 0.010 g |
| Compound Cpd-K | | 2.0 mg |
| Ultraviolet absorbent U-6 | | 5.0 mg |
| High-boiling organic solvent Oil-2 | | 0.10 g |
| High-boiling organic solvent Oil-6 | | 0.030 g |
| **10th layer: Medium-speed green-sensitive emulsion layer** | | |
| Emulsion I | silver | 0.20 g |
| Emulsion J | silver | 0.30 g |
| Internally fogged silver bromide emulsion (cubic, average equivalent-sphere grain size 0.11 μm) | silver | 5.0 mg |
| Gelatin | | 0.70 g |
| Coupler C-4 | | 0.40 g |
| Compound Cpd-B | | 0.030 g |
| Compound Cpd-F | | 0.010 g |
| Compound Cpd-G | | 2.0 mg |

-continued

| | | |
|---|---|---|
| High-boiling organic solvent Oil-2 | | 0.050 g |
| High-boiling organic solvent Oil-5 | | 6.0 mg |
| 11th layer: High-speed green-sensitive emulsion layer | | |
| Emulsion K | silver | 0.65 g |
| Gelatin | | 0.70 g |
| Coupler C-4 | | 0.50 g |
| Compound Cpd-B | | 0.050 g |
| Compound Cpd-F | | 0.010 g |
| Compound Cpd-K | | 2.0 mg |
| High-boiling organic solvent Oil-2 | | 0.050 g |
| 12th layer: Interlayer | | |
| Gelatin | | 0.50 g |
| Compound Cpd-M | | 0.05 g |
| High-boiling organic solvent Oil-3 | | 0.025 g |
| High-boiling organic solvent Oil-6 | | 0.025 g |
| Dye D-6 | | 5.0 mg |
| 13th layer: Yellow filter layer | | |
| Yellow colloidal silver | silver | 8.0 mg |
| Gelatin | | 1.00 g |
| Compound Cpd-C | | 0.010 g |
| Compound Cpd-M | | 0.030 g |
| High-boiling organic solvent Oil-1 | | 0.020 g |
| High boiling organic solvent Oil-6 | | 0.030 g |
| Fine-crystal solid dispersion of dye E-2 | | 0.20 g |
| 14th layer: Interlayer | | |
| Gelatin | | 0.40 g |
| Compound Cpd-Q | | 0.20 g |
| 15th layer: Low-speed blue-sensitive emulsion layer | | |
| Emulsion L | silver | 0.20 g |
| Emulsion M | silver | 0.20 g |
| Gelatin | | 0.80 g |
| Coupler C-5 | | 0.020 g |
| Coupler C-6 | | 5.0 mg |
| Coupler C-10 | | 0.30 g |
| Compound Cpd-B | | 0.10 g |
| Compound Cpd-I | | 8.0 mg |
| Compound Cpd-K | | 1.0 mg |
| Compound Cpd-M | | 0.010 g |
| Ultraviolet absorbent U-6 | | 0.010 g |
| High-boiling organic solvent Oil-2 | | 0.010 g |
| 16th layer: Medium-speed blue-sensitive emulsion layer | | |
| Emulsion N | silver | 0.20 g |
| Emulsion O | silver | 0.15 g |
| Internally fogged silver bromide emulsion (cubic, average equivalent-sphere grain size 0.11 μm) | silver | 3.0 mg |
| Gelatin | | 0.90 g |
| Coupler C-5 | | 0.020 g |
| Coupler C-6 | | 0.010 g |
| Coupler C-10 | | 0.25 g |
| Compound Cpd-B | | 0.10 g |
| Compound Cpd-N | | 2.0 mg |
| High-boiling organic solvent Oil-2 | | 0.010 g |
| 17th layer: High-speed blue-sensitive emulsion layer | | |
| Emulsion O | silver | 0.20 g |
| Emulsion P | silver | 0.20 g |
| Gelatin | | 2.00 g |
| Coupler C-3 | | 5.0 mg |
| Coupler C-5 | | 0.10 g |
| Coupler C-6 | | 0.020 g |
| Coupler C-10 | | 1.00 g |
| High-boiling organic solvent Oil-2 | | 0.10 g |
| High-boiling organic solvent Oil-3 | | 0.020 g |
| Ultraviolet absorbent U-6 | | 0.10 g |
| Compound Cpd-B | | 0.20 g |
| Compound Cpd-N | | 5.0 mg |
| 18th layer: 1st protective layer | | |
| Gelatin | | 1.00 g |
| Ultraviolet absorbent U-1 | | 0.15 g |

-continued

| | | |
|---|---|---|
| Ultraviolet absorbent U-2 | | 0.050 g |
| Ultraviolet absorbent U-5 | | 0.20 g |
| Compound Cpd-O | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.10 g |
| 19th layer: 2nd protective layer | | |
| Colloidal silver | silver | 3.0 mg |
| Fine-grain silver iodobromide emulsion (average grain size 0.06 μm, AgI content 1 mol %) | silver | 0.10 g |
| Gelatin | | 0.80 g |
| Ultraviolet absorbent U-1 | | 0.010 g |
| Ultraviolet absorbent U-6 | | 0.010 g |
| High-boiling organic solvent Oil-3 | | 0.010 g |
| 20th layer: 3rd protectiver layer | | |
| Gelatin | | 1.20 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SO-1 | | 0.20 g |
| Surfactant W-1 | | 0.040 g |
| Surfactant W-2 | | 0.015 g |

In addition to the above compositions, additives F-1 to F-8 were added to all emulsion layers. Also, a gelatin hardener H-1 and surfactants W-1, W-3, and W-4 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

TABLE 1

Emulsions used in Sample 101 are as follows:

| Emulsion | Features | Av. E.S.D. (μm) | C.O.V (%) | AgI content (%) |
|---|---|---|---|---|
| A | Monodisperse Tetradecahedral grains | 0.18 | 12 | 4.0 |
| B | Monodisperse (100) Tbl Grains having A.A. Ratio of 5.0 | 0.27 | 15 | 4.2 |
| C | Monodisperse (111) internally-fogged-type Tbl Grains having A.A. Ratio of 10.0 | 0.33 | 18 | 3.5 |
| D | Monodisperse (111) Tbl Grains having A.A. Ratio of 12.0 | 0.40 | 18 | 2.8 |
| E | Monodisperse (111) Tbl Grains having A.A. Ratio of 15.0 | 0.45 | 13 | 1.8 |
| F | Monodisperse (111) Tbl Grains having A.A. Ratio of 20.0 | 0.60 | 15 | 1.5 |
| G | Monodisperse cubic grains | 0.18 | 12 | 3.5 |
| H | Monodisperse internally-fogged-type Tbl Grains | 0.27 | 10 | 3.0 |
| I | Monodisperse (111) Tbl Grains having A.A. Ratio of 7.0 | 0.35 | 17 | 3.2 |
| J | Monodisperse (111) Tbl Grains having A.A. Ratio of 10.0 | 0.45 | 16 | 2.5 |

TABLE 1-continued

Emulsions used in Sample 101 are as follows:

| Emulsion | Features | Av. E.S.D. (μm) | C.O.V (%) | AgI content (%) |
|---|---|---|---|---|
| K | Monodisperse (111) Tbl Grains having A.A. Ratio of 20.0 | 0.55 | 13 | 2.0 |
| L | Monodisperse (100) Tbl Grains having A.A. Ratio of 6.0 | 0.35 | 10 | 4.0 |
| M | Monodisperse (111) Tbl Grains having A.A. Ratio of 8.0 | 0.33 | 10 | 6.0 |
| N | Monodisperse (111) Tbl Grains having A.A. Ratio of 15.0 | 0.48 | 10 | 3.5 |
| O | Monodisperse (111) Tbl Grains having A.A. Ratio of 20.0 | 0.70 | 9 | 1.5 |
| P | Monodisperse (111) Tbl Grains having A.A. Ratio of 20.0 | 0.90 | 8 | 0.8 |

Av. E.S.D = Average equivalent sphere diameter
C.O.V = coefficient of variation
Tbl Grains = Tabular grains
A.A. Ratio = Average aspect ratio

TABLE 2

Spectral sensitization of emulsions A to P

| Emulsion | Added spectral sensitizing dye | Addition amount per mol of silver halide (g) |
|---|---|---|
| A | S-2 | 0.40 |
| | S-3 | 0.02 |
| | S-8 | 0.03 |
| | S-13 | 0.010 |
| | S-14 | 0.01 |
| B | S-2 | 0.40 |
| | S-3 | 0.02 |
| | S-8 | 0.03 |
| | S-13 | 0.010 |
| C | S-2 | 0.40 |
| | S-3 | 0.04 |
| | S-8 | 0.04 |
| | S-13 | 0.02 |
| D | S-2 | 0.40 |
| | S-3 | 0.05 |
| | S-8 | 0.05 |
| | S-13 | 0.015 |
| E | S-1 | 0.01 |
| | S-2 | 0.45 |

TABLE 2-continued

Spectral sensitization of emulsions A to P

| Emulsion | Added spectral sensitizing dye | Addition amount per mol of silver halide (g) |
|---|---|---|
| | S-3 | 0.05 |
| | S-8 | 0.05 |
| | S-13 | 0.01 |
| F | S-2 | 0.5 |
| | S-3 | 0.04 |
| | S-8 | 0.04 |
| G | S-4 | 0.4 |
| | S-5 | 0.05 |
| | S-12 | 0.1 |
| H | S-4 | 0.2 |
| | S-5 | 0.05 |
| | S-9 | 0.20 |
| | S-14 | 0.02 |
| I | S-4 | 0.25 |
| | S-9 | 0.25 |
| | S-12 | 0.1 |
| J | S-4 | 0.30 |
| | S-5 | 0.05 |
| | S-12 | 0.1 |
| K | S-4 | 0.40 |
| | S-12 | 0.1 |
| | S-14 | 0.02 |
| L | S-6 | 0.1 |
| | S-10 | 0.2 |
| | S-11 | 0.05 |
| M | S-6 | 0.05 |
| | S-7 | 0.05 |
| | S-10 | 0.30 |
| | S-11 | 0.05 |
| N | S-10 | 0.35 |
| | S-11 | 0.15 |
| O | S-6 | 0.05 |
| | S-10 | 0.35 |
| | S-11 | 0.1 |
| P | S-6 | 0.05 |
| | S-7 | 0.05 |
| | S-10 | 0.2 |
| | S-11 | 0.30 |

C-1

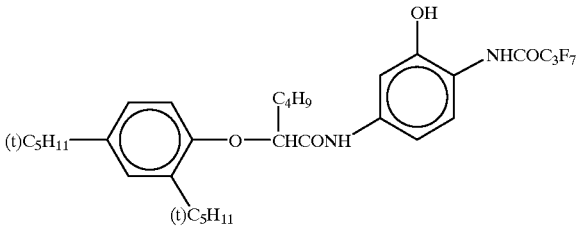

C-2

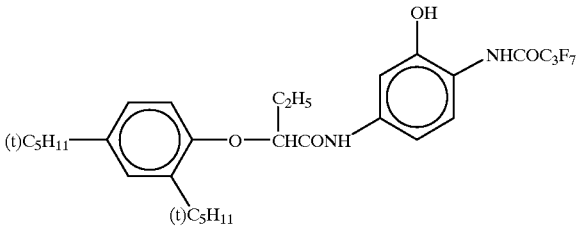

-continued
C-3
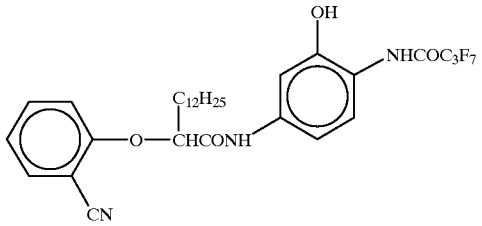
C-4
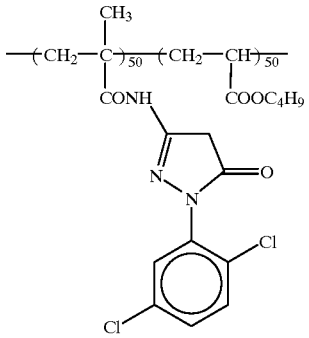
The numbers are in wt. ratio
Av. mol. wt.: about 25,000
C-5
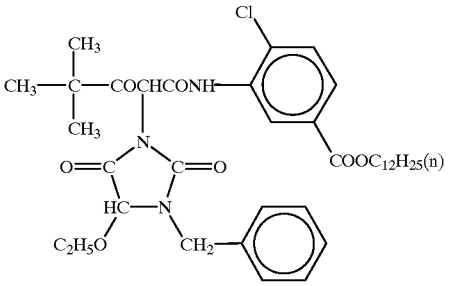
C-6
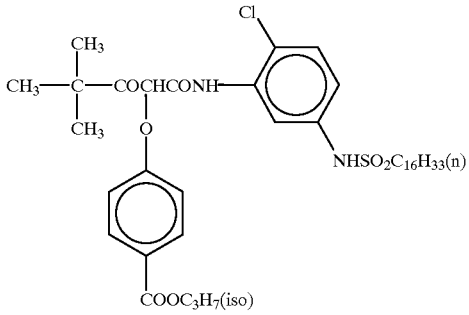
C-7
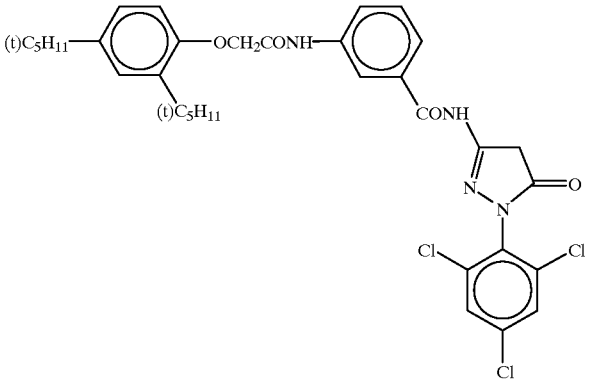
C-10
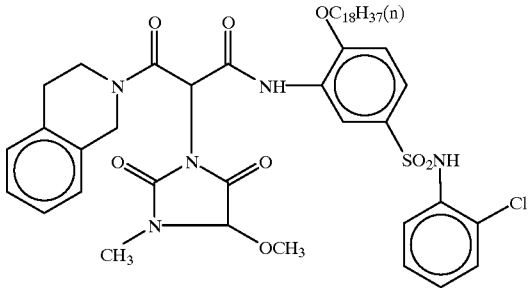
Oil-1
Tri-n-hexyl phosphate
Oil-2
Tricresyl phosphate
Oil-3
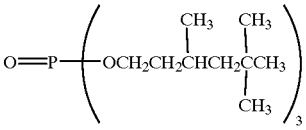
Oil-4
Tricyclohexyl phosphate
Oil-5
Bis(2-ethylhexyl) succinatej
Oil-6
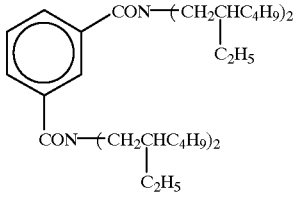

-continued
Oil-7
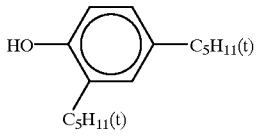
Cpd-A
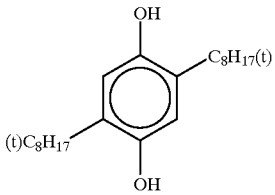
Cpd-B
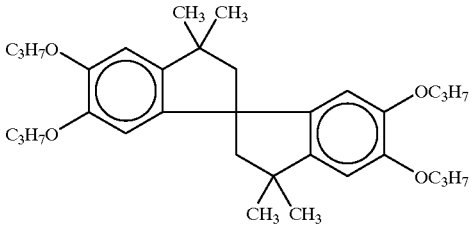
Cpd-C
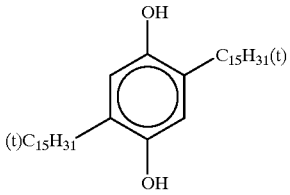
Cpd-D
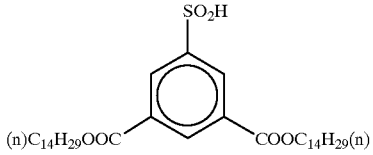
Cpd-E
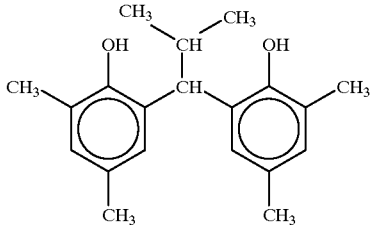
Cpd-F
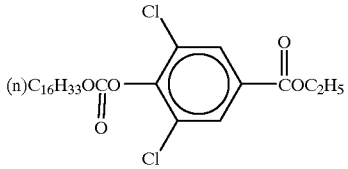
Cpd-G
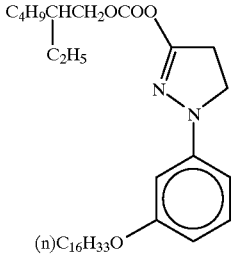
Cpd-H
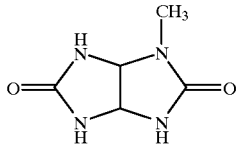
Cpd-I
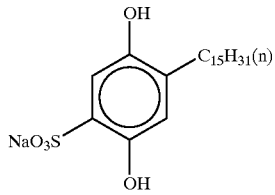
Cpd-J
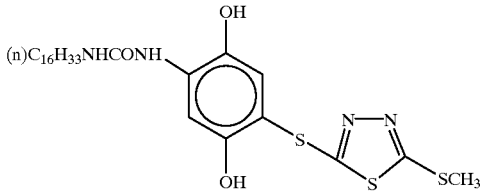
Cpd-K
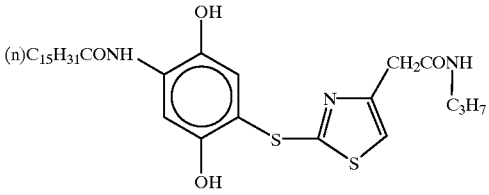
Cpd-L
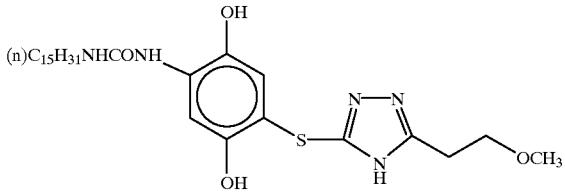
Cpd-M
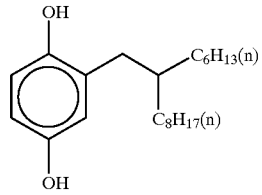

-continued
Cpd-N
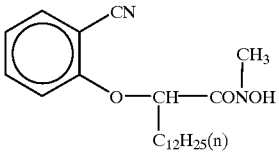
Cpd-O
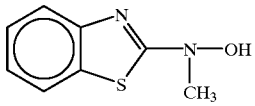
Cpd-P
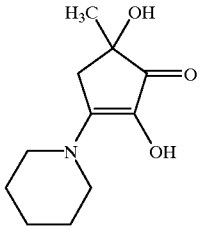
Cpd-Q
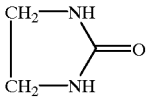
U-1
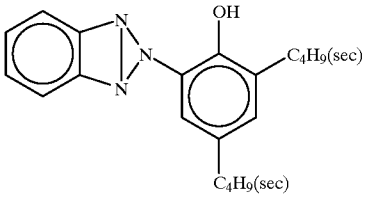
U-2
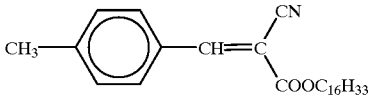
U-3
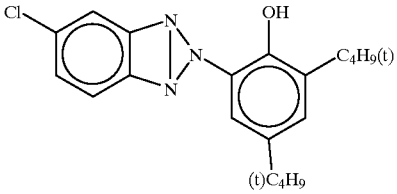
U-4
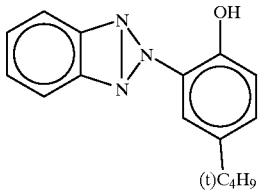
U-5
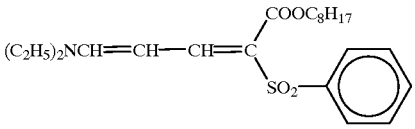
U-6
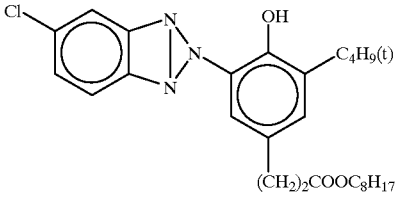
S-1
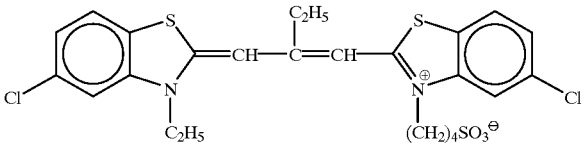
S-2
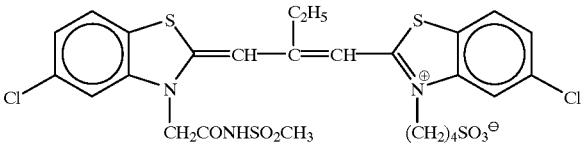
S-3
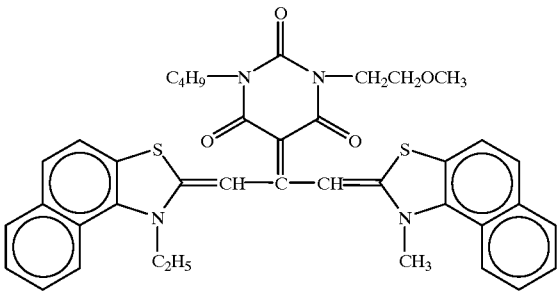
S-4
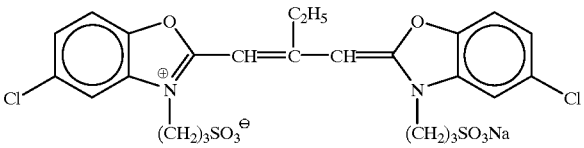

-continued
S-5
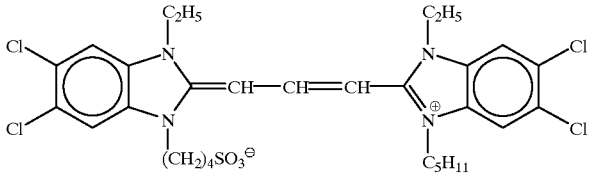
S-6
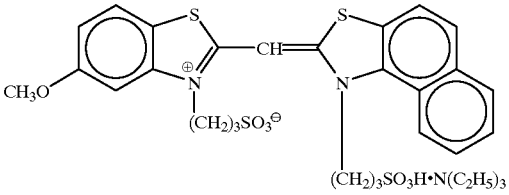
S-7
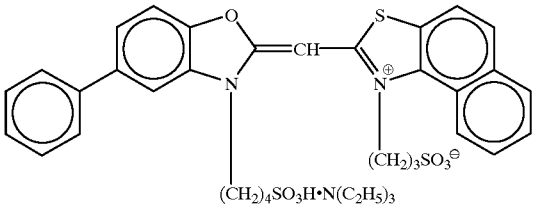
S-8
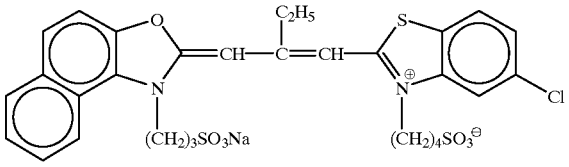
S-9
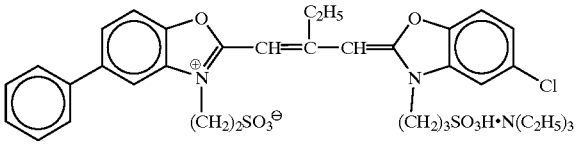
S-10
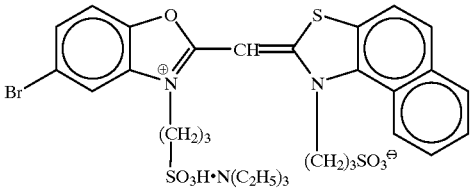
S-11
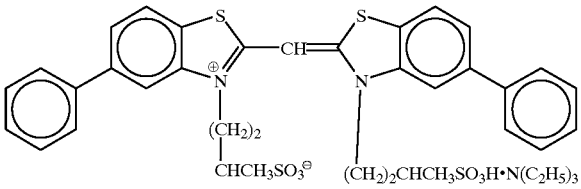
S-12
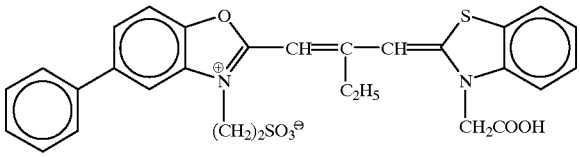
S-13
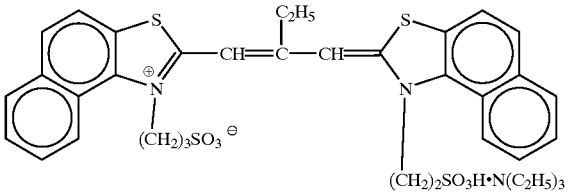
S-14
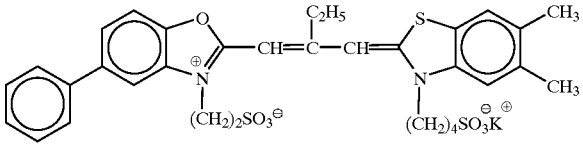
D-1
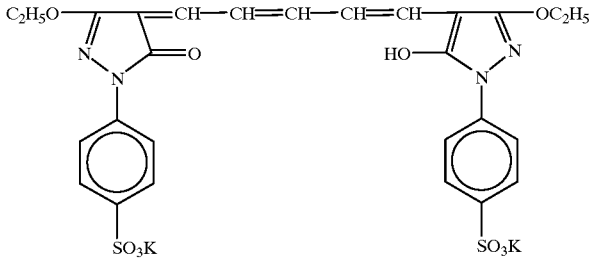
D-2
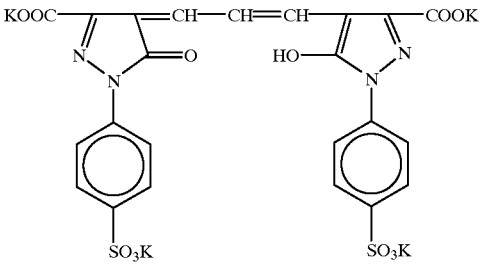

-continued
D-3
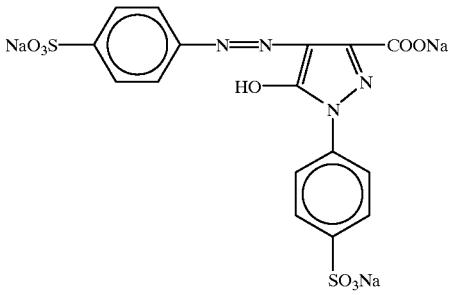
D-4
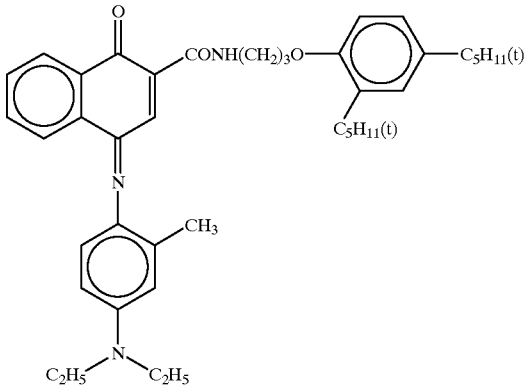
D-5
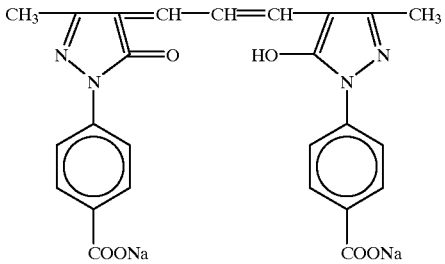
D-6
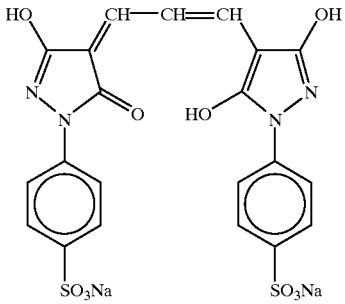
D-7
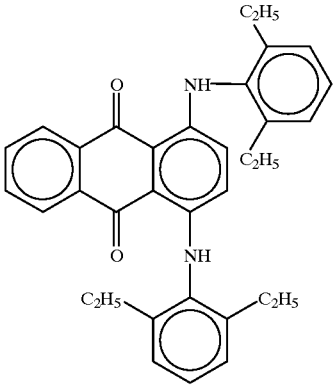
D-8
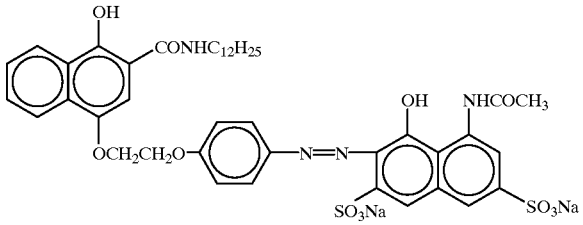
D-9
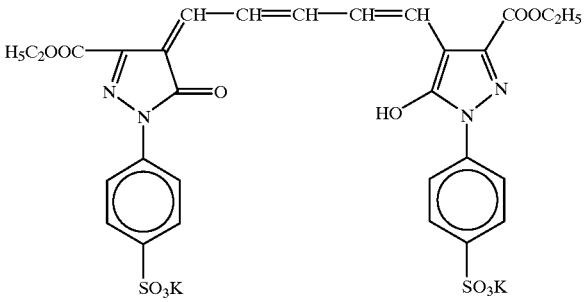
E-1
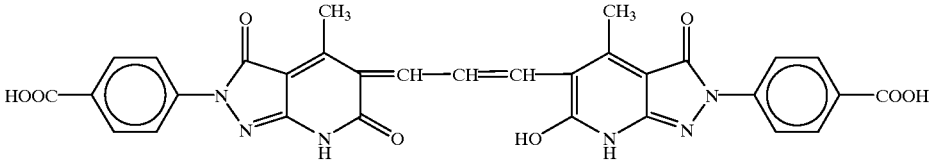

-continued
E-2
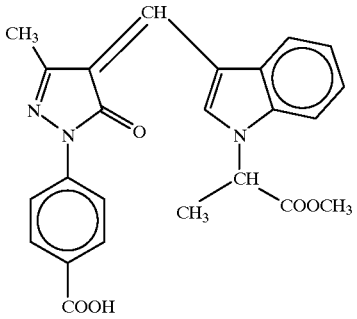
H-1
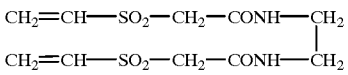
W-1
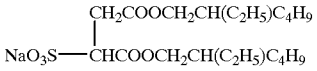
W-2
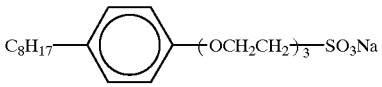
W-3
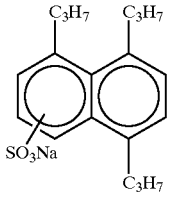
W-4
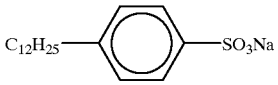
P-1
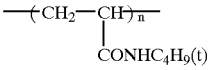
(n = 100~1000)
P-2
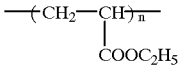
(n = 100~1000)
SO-1
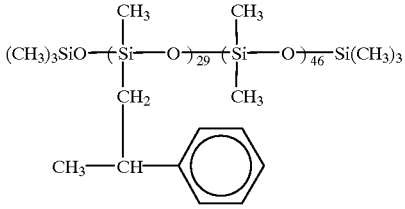
F-1
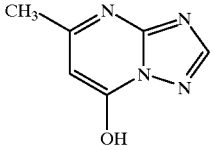
F-2
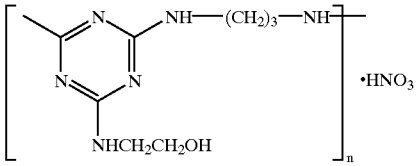
(n = 3~4)
F-3
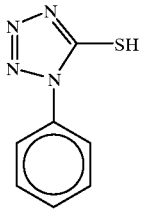
F-4
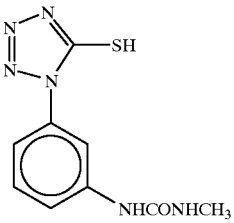
F-5
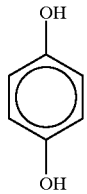

-continued

F-6

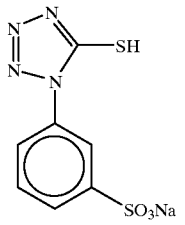

F-7

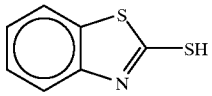

F-8

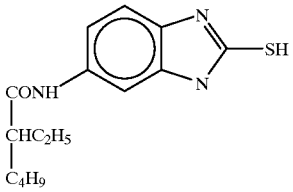

Preparation of Dispersions of Organic Solid Disperse Dyes (Preparation of Dispersion of Dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 $\mu$m, and the grain size distribution (grain size standard deviation×100/average grain size) was 20%.

(Preparation of Solid Dispersion of Ddye E-2)

Water and 270 g of W-4 were added to 1,400 g of a wet cake of E-2 containing 30 wt % of water, and the resultant material was stirred to form a slurry having an E-2 concentration of 40 wt %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, thereby obtaining a solid fine-grain dispersion of E-2. This dispersion was diluted to 20 wt % by ion exchange water to obtain a solid fine-grain dispersion. The average grain size was 0.15 $\mu$m.

Samples 102 to 113 were prepared by replacing the couplers and high-boiling organic solvents in the 4th, 5th, 6th, and 9th layers, and 10th, and 11th layers of sample 101 as shown in Table 3. Also, samples 206 and 207 were formed by switching the positions of the red-sensitive unit (4th, 5th, and 6th layers) and the green-sensitive unit (9th, 10th, and 11th layers) of samples 106 and 107, respectively.

The couplers were replaced such that a pyrazolotriazole coupler was 65% with respect to C-7 and 70% with respect to C-4 as a molar ratio. Also, a comparative coupler A and a cyan coupler of the present invention were used such that the numbers of moles were equal to those of C-1, C-2, and C-3.

To compensate for changes in gray balance caused by these changes of couplers, in each sample using a pyrazolotriazole coupler the coating amounts of all blue-sensitive emulsion layers were increased by 1.15 times while the ratios of the contents were kept unchanged. Also, in each sample using the comparative coupler A or the cyan coupler of the present invention, the coating amount of each green-sensitive layer was similarly increased by 1.1 times.

TABLE 3

| | | Sample arrangements | | | |
|---|---|---|---|---|---|
| Sample No. | Remarks | Coupler in 4th, 5th and 6th layers | High-boiling organic solvent (addition amount) | Coupler in 9th, 10th and 11th layers | High-boiling organic solvent (addition amount) |
| 101 | Comp | As described in the specification | | As described in the specification | |
| 102 | Comp | Coupler A for comparison | Dibutyl phthalate (0.5) | Same as Sample 101 | |
| 103 | Comp | Same as Sample 101 | | MC-30 | Oil-2 (0.5) |
| 104 | Comp. | Coupler A for comparison | Dibutyl phthalate (0.5) | MC-30 | Oil-2 (0.5) |
| 105 | Inv. | CC-7 | Dibutyl phthalate (0.5) | MC-30 | Oil-2 (0.5) |
| 106 | Inv. | CC-1 | Dibutyl phthalate (0.5) | MC-26 | Oil-2 (0.5) |
| 107 | Inv. | CC-1 | Dibutyl phthalate (0.5) | MC-2 | Oil-2 (0.5) |

TABLE 3-continued

Sample arrangements

| Sample No. | Remarks | Coupler in 4th, 5th and 6th layers | High-boiling organic solvent (addition amount) | Coupler in 9th, 10th and 11th layers | High-boiling organic solvent (addition amount) |
|---|---|---|---|---|---|
| 108 | Inv. | CC-1 | Di-n-octyl succinate (0.3) | MC-2 | Oil-2 (0.5) |
| 109 | Inv. | CC-1 | Di-n-octyl succinate (0.1) | MC-4 | Oil-1 (0.2) |
| 110 | Inv. | CC-5 | Tri-n-hexyl trimellitate (0.3) | MC-17 | Oil-4 (0.3) |
| 111 | Inv. | CC-7 | Tri-n-hexyl trimellitate (0.1) | MC-33 | Oil-3 (0.2) |
| 112 | Inv. | CC-7 | Dibutyl phthalate (0.1) | MC-23 | Oil-3 (0.2) |
| 113 | Inv. | CC-7 | Dibutyl phthalate (0.1) | MC-27 | Oil-3 (0.2) |
| 206 | Comp | Ingredients are the same as Sample 106, but the positions of the green-sensitive unit is interchanged with that of the red-sensitive unit. | | | |
| 207 | Comp | Ingredients are the same as Sample 107, but the positions of the green-sensitive unit is interchanged with that of the red-sensitive unit. | | | |

Coupler A for comparison

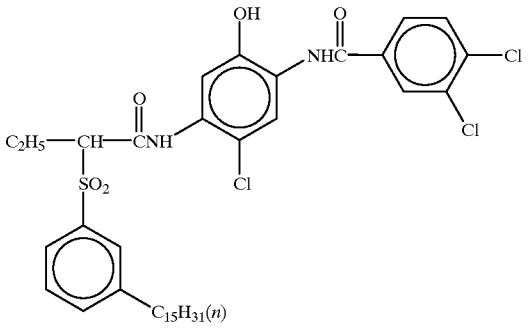

In this Example, the following development processing steps (development A) was performed.

| Processing Step | Time | Temperature | Tank volume | Replenishment rate |
|---|---|---|---|---|
| 1st development | 6 min | 38° C. | 37 L | 2,200 mL/m$^2$ |
| 1st washing | 2 min | 38° C. | 16 L | 4,000 mL/m$^2$ |
| Reversal | 2 min | 38° C. | 17 L | 1,100 mL/m$^2$ |
| Color development | 6 min | 38° C. | 30 L | 2,200 mL/m$^2$ |
| Pre-bleaching | 2 min | 38° C. | 19 L | 1,100 mL/m$^2$ |
| Bleaching | 6 min | 38° C. | 30 L | 220 mL/m$^2$ |
| Fixing | 4 min | 38° C. | 29 L | 1,100 mL/m$^2$ |
| 2nd washing | 4 min | 38° C. | 35 L | 4,000 mL/m$^2$ |
| Final rinsing | 1 min | 25° C. | 19 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid. pentasodium salt | 1.5 g | 1.5 g |
| Diethylenetriamine pentaacetic acid. pentasodium salt | 2.0 g | 2.0 g |
| Sodium sulfite | 30 g | 30 g |
| Hydroquinone.potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid. pentasodium salt | 3.0 g | the same as tank solution |
| Stannous chloride.dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color Developer> | <Tank solution> | <Replenisher> |
|---|---|---|
| Nitrilo-N,N,N-trimethylene phosphonic acid. pentasodium salt | 2.0 g | 2.0 g |
| Sodium sulfite | 7.0 g | 7.0 g |
| Trisodium phosphate. dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfon | 11 g | 11 g |

-continued

| <Color Developer> | <Tank solution> | <Replenisher> |
|---|---|---|
| amidoethyl)-3-methyl-4 aminoaniline.3/2 sulfuric acid.monohydrate | | |
| 3,6-dithiaoctane-1,8-diol | 1.0 g | 1.0 g |
| Water to make | 1,000 mL | 1,000 mL |
| pH | 11.70 | 11.90 |

The pH was adjusted by sulfuric acid or potassium hydroxide.

| <Pre-bleaching solution> | <Tank solution> | <Replenisher> |
|---|---|---|
| Ethylenediaminetetraacetic acid.disodium salt. dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid.disodium salt. dihydrate | 2.0 g | 4.0 g |
| Ethylenediaminetetraacetic acid.Fe(III).ammonium. dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

In the above development process, the solution was continuously circulated and stirred in each bath. In addition, a blowing pipe having small holes 0.3 mm in diameter formed at intervals of 1 cm was attached to the lower surface of each tank to continuously blow nitrogen gas to stir the solution.

(Evaluation of Samples)

(Evaluation of Graininess)

One set of samples 101 to 113, 206, and 207 were evenly exposed such that a neutral gray density of 1.0 was given in (development A), and subjected to (development A).

After the processing, the RMS granularity of each sample was measured. The results are shown in Table 4. The smaller the numerical value, the higher the graininess.

(Evaluation of Processing Dependence)

Samples 101 to 113, 206, and 207 were similarly exposed such that a neutral gray density of 1.0 was given, and subjected to (development A). Subsequently, another set of samples 101 to 113, 206, and 207 were exposed under the same conditions, and processed following the same procedure as in (development A) except that the pH of the color developer tank solution was 12.1 (development B).

Changes in color balance were calculated as follows.

Cyan density variation (ΔDc)=cyan density in (development B)−cyan density in (development A)

Magenta density variation (ΔDm)=magenta density in (development B)−magenta density in (development A)

Color balance variation (ΔCB)=(ΔDm)−(ΔDc)

That is, when ΔCB is positive, the color balance shifts to magenta in processing performed at pH 12.1 more than in processing performed at pH 11.7; when ΔCB is negative, the color balance shifts to cyan.

The closer the absolute value of ΔCB to zero, the better the color balance. The results are shown in Table 4.

TABLE 4

| Sample | Remarks | RMS granularity at density of 1.0 (V density) (× 1000-fold) | Stability of color balance ΔCB |
|---|---|---|---|
| 101 | Comp. | 9.0 | −0.05 |
| 102 | Comp. | 10.0 | +0.05 |
| 103 | Comp. | 11.0 | +0.13 |
| 104 | Comp. | 12.0 | +0.15 |
| 105 | Inv. | 9.5 | +0.06 |
| 106 | Inv. | 9.5 | +0.06 |
| 107 | Inv. | 9.0 | +0.02 |
| 108 | Inv. | 8.5 | +0.01 |
| 109 | Inv. | 8.5 | 0 |
| 110 | Inv. | 8.5 | +0.01 |
| 111 | Inv. | 8.5 | +0.01 |
| 112 | Inv. | 8.5 | 0 |
| 113 | Inv. | 9.0 | +0.02 |
| 206 | Comp. | 10.0 | +0.12 |
| 207 | Comp. | 9.0 | +0.12 |

(Results of Evaluation)

In sample 101, the gray balance slightly shifted to cyan when the pH of the color development was high. In sample 102 in which the cyan coupler was replaced with the comparative coupler A disclosed in examples of U.S. Pat. No. 5,888,716, the gray balance slightly shifted to magenta when the pH of the color development was high. The graininess also worsened in sample 102.

In sample 104 in which the magenta coupler of sample 102 was changed to the combination disclosed in U.S. Pat. No. 5,888,716, the gray balance largely shifted to magenta when the pH of the color development was high, which raised a problem.

By contrast, in samples 105 to 113 using the 4-equivalent phenol cyan coupler of the present invention, disturbance of the gray balance by pH variations was improved.

Examples of U.S. Pat. No. 5,888,716 disclosed color paper using both a 2-equivalent cyan coupler and a 2-equivalent pyrazolo triazole coupler. However, no light-sensitive material using both a 4-equivalent cyan coupler and a 2- or 4-equivalent pyrazolotriazole coupler is disclosed. In addition, it is not known that preferred results as described above can be obtained by the combination of a 4-equivalent cyan coupler and a pyrazolotriazole coupler when a light-sensitive material is processed by a color developer having a high pH of 11.5 or more.

As can be seen from comparison of sample 106 with sample 107, the graininess was improved and disturbance of the gray balance by pH variations was further improved when the pyrazolotriazole coupler was also a 4-equivalent coupler.

In sample 108 and after the amount of high-boiling organic solvent used in a coupler of formula (CC-I) was 0.3 or less as a weight ratio with respect to the coupler, the processing stability of the gray balance was further improved, so favored results were obtained.

In samples 206 and 207, almost no processing dependence improving effect was found. That is, the environment in which each coupler existed changed depending on the position of the light-sensitive units in the multilayerd construction. This reveals that the effect of the present invention was achieved when the red-sensitive unit and the green-sensitive unit were arranged in this order from a support.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic light-sensitive material having, on a support, at least one red-sensitive emulsion layer, at least one green-sensitive emulsion layer, and at least one blue-sensitive emulsion layer in this order from the one nearest to the support, wherein said at least one green-sensitive emulsion layer contains a coupler represented by a formula (MC-I) below, and said at least one red-sensitive emulsion layer contains a coupler represented by a formula (CC-I) below:

(MC-I)

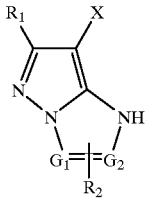

wherein, in formula (MC-I), $R_1$ represents a hydrogen atom or substituent; one of $G_1$ and $G_2$ represents a carbon atom, the other represents a nitrogen atom; and $R_2$ represents a substituent which substitutes one of $G_1$ and $G_2$ that is a carbon atom, provided that $R_1$ and $R_2$ can further have a substituent, a polymer having a repeating unit of formula (MC-I) can be formed via $R_1$ and/or $R_2$, and at least one coupler of formula (MC-I) can bond to a polymer chain via $R_1$ or $R_2$; X represents a hydrogen atom or a group which can split off in a coupling reaction with an oxidized formed of an aromatic primary amine color developing agent;

(CC-I)

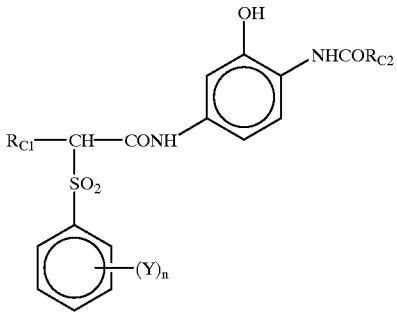

wherein, in formula (CC-I), $R_{c1}$ represents a hydrogen atom or alkyl group; $R_{c2}$ represents an alkyl group or aryl group; n represents 1, 2, or 3; and each Y is positioned in the meta and/or para position of the phenyl group with respect to the sulfonyl group, and independently represents a group selected from the group consisting of alkyl, alkenyl, alkoxy, aryloxy, acyloxy, acylamino, sulfonyloxy, sulfamoylamino, sulfonamide, ureido, oxycarbonyl, oxycarbonylamino, and carbamoyl groups, wherein said material is a color reversal film photographic light-sensitive material.

2. The silver halide color photographic light-sensitive material according to claim 1, wherein an amount of the coupler represented by the formula (MC-I) is 70 mol % or more with respect to the total amount of couplers capable of forming images of magenta color, and an amount of the coupler represented by the formula (CC-I) is 70 mol % or more with respect to the total amount of couplers capable of forming images of cyan color.

3. The silver halide color photographic light-sensitive material according to claim 2, wherein a number of the red-sensitive emulsion layer is two or more each having different speeds thereby to form a unit configuration, a number of the green-sensitive emulsion layer is two or more each having different speeds thereby to form a unit configuration, and a number of the blue-sensitive emulsion layer is two or more each having different speeds thereby to form a unit configuration.

4. The silver halide color photographic light-sensitive material according to claim 3, wherein, in the formula (MC-I), $G_1$ is a carbon atom; and $G_2$ is a nitrogen atom.

5. The silver halide color photographic light-sensitive material according to claim 3, wherein a weight ratio, with respect to the coupler represented by the formula (CC-I), of a high-boiling organic solvent used for the coupler represented by the formula (CC-I) is 0 to 0.3.

6. The silver halide color photographic light-sensitive material according to claim 4, wherein a weight ratio, with respect to the coupler represented by the formula (CC-I), of a high-boiling organic solvent used for the coupler represented by the formula (CC-I) is 0 to 0.3.

7. The silver halide color photographic light-sensitive material according to claim 4, wherein X of the formula (MC-I) is a hydrogen atom.

8. The silver halide color photographic light-sensitive material according to claim 3, wherein, in the formula (MC-I), $G_1$ is a carbon atom; $G_2$ is a nitrogen atom; and $R_2$ is represented by a general formula (BL-2):

(BL-2)

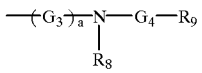

wherein $G_3$ represents a substituted or unsubstituted methylene group; a represents an integer from 1 to 3; $G_4$ represents —O—, —$SO_2$—, —$NR_8CO$—, or —$NR_8SO_2$— (wherein $R_8$ represents a hydrogen atom, alkyl group, or aryl group); and $R_9$ represents a substituent having a group selected from the group consisting of —OH, —$SO_2NH_2$, —$SO_2NHR_{10}$, —$NHSO_2R_{10}$, —$SO_2NHCOR_{10}$, —$CONHSO_2R_{10}$, —COOH, and —$CONH_2$ (wherein $R_{10}$ represents a substituted or unsubstituted alkyl group, or a substituted or unsubstituted aryl group), as a partial structure.

9. A color image-forming method comprising:

developing the silver halide color photographic light-sensitive material according to claim 1 with a color developer containing an aromatic primary amine color developing agent and having a pH value of 11.5 or more.

10. A color image-forming method comprising:

black-and-white developing;

reversal processing; and followed by color-developing the silver halide color reversal photographic light-sensitive material according to claim 3 with a color developer having a pH value of 11.5 or more.

11. The color image-forming method according to claim 10, wherein, in the formula (MC-I), $G_1$ is a carbon atom; and $G_2$ is a nitrogen atom.

12. The color image-forming method according to claim 10, wherein the light-sensitive material contains a high-boiling organic solvent, and a weight ratio, with respect to the coupler represented by the formula (CC-I), of the high-boiling organic solvent used for the coupler represented by the formula (CC-I) is 0 to 0.3.

13. The color image-forming method according to claim 11, wherein the light-sensitive material contains a high-boiling organic solvent, and a weight ratio, with respect to the coupler represented by the formula (CC-I), of the high-boiling organic solvent used for the coupler represented by the formula (CC-I) is 0 to 0.3.

14. The color image-forming method according to claim 10, wherein, in the formula (MC-I), X is a hydrogen atom; $G_1$ is a carbon atom; and $G_2$ is a nitrogen atom.

15. The color image-forming method according to claim 10, wherein, in the formula (MC-I), $G_1$ is a carbon atom; $G_2$ is a nitrogen atom; and $R_2$ is represented by a general formula (BL-2):

(BL-2)

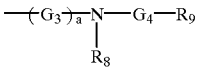

wherein $G_3$ represents a substituted or unsubstituted methylene group; a represents an integer from 1 to 3; $G_4$ represents —O—, —$SO_2$—, —$NR_8CO$—, or —$NR_8SO_2$— (wherein $R_8$ represents a hydrogen atom, alkyl group, or aryl group); and $R_9$ represents a substituent having a group selected from the group consisting of —OH, —$SO_2NH_2$, —$SO_2NHR_{10}$, —$NHSO_2R_{10}$, —$SO_2NHCOR_{10}$, —$CONHSO_2R_{10}$, —COOH, and —$CONH_2$ (wherein $R_{10}$ represents a substituted or unsubstituted alkyl group, or a substituted or unsubstituted aryl group), as a partial structure.

16. The silver halide color photographic light-sensitive material according to claim 1, wherein said coupler of formula (CC-1) is contained in an amount of 0.1–2 g/$m^2$.

17. The silver halide color photographic light-sensitive material according to claim 1, wherein said coupler of formula (MC-1) is contained in an amount of 0.1–2 g/$m^2$.

18. The silver halide color photographic light-sensitive material according to claim 1, wherein the content of coupler is $1\times10^{-}$ to 1 mol per mol of silver halide in the same photosensitive emulsion layer.

19. The silver halide color photographic light-sensitive material according to claim 1, wherein said coupler of formula (CC-1) is contained in an amount of 0.1–2 g/$m^2$, said coupler of formula (MC-1) is contained in an amount of 0.1–2 g/$m^2$, and the content of coupler is $1\times10^{-}$ to 1 mol per mol of silver halide in the same photosensitive emulsion layer.

* * * * *